US005814437A

United States Patent [19]

Nakahanada et al.

[11] Patent Number: 5,814,437

[45] Date of Patent: Sep. 29, 1998

[54] METHOD FOR PROCESSING SILVER HALIDE PHOTOGRAPHIC LIGHT-SENSITIVE MATERIAL

[75] Inventors: Manabu Nakahanada; Yutaka Ueda, both of Tokyo, Japan

[73] Assignee: Konica Corporation, Japan

[21] Appl. No.: 960,114

[22] Filed: Oct. 27, 1997

Related U.S. Application Data

[63] Continuation of Ser. No. 644,311, May 10, 1996.

[30] Foreign Application Priority Data

May 22, 1995 [JP] Japan ..... 7-122556

[51] Int. Cl.[6] ..... G03C 7/42

[52] U.S. Cl. ..... 430/393; 430/400; 430/455; 430/460

[58] Field of Search ..... 430/393, 400, 430/455, 460

[56] References Cited

U.S. PATENT DOCUMENTS

| | | | |
|---|---|---|---|
| 5,066,570 | 11/1991 | Nakamura et al. | 430/421 |
| 5,108,878 | 4/1992 | Nakamura | 430/421 |
| 5,338,648 | 8/1994 | Kojima et al. | 430/455 |
| 5,380,627 | 1/1995 | Grimsey | 430/398 |

FOREIGN PATENT DOCUMENTS

| | | |
|---|---|---|
| 559025 | 9/1993 | European Pat. Off. . |
| 61-15424 | 4/1986 | Japan . |
| 261640 | 10/1989 | Japan . |
| 7041 | 1/1990 | Japan . |
| 1138842 | 1/1969 | United Kingdom . |

*Primary Examiner*—Hoa Van Le
*Attorney, Agent, or Firm*—Jordan B. Bierman; Bierman, Muserlian and Lucas

[57] ABSTRACT

A method for processing a silver halide photographic light-sensitive material is by an automatic processor having a processing chamber with a small volume. The processing method comprises the step of conveying a silver halide photographic light-sensitive material imagewise exposed to light and developed, through a chamber which is filled with a solution having a fixing ability, in which the processing chamber comprises an upper member constituting an upper wall of the chamber, a lower member constituting a bottom wall of the chamber and a means for conveying the light-sensitive material, and said upper wall and said bottom wall of said processing chamber form a small volume, and the solution having a fixing ability contains a fixing agent and a compound represented by the following Formula I, II, III or IV:

Formula I

Formula II

Formula III

Formula IV

10 Claims, 8 Drawing Sheets

METHOD FOR PROCESSING SILVER HALIDE PHOTOGRAPHIC LIGHT-SENSITIVE MATERIAL

This is a continuation of application Ser. No. 08/644,311 filed May 10, 1996.

FIELD OF THE INVENTION

This invention relates to a method for processing a silver halide photographic light-sensitive material, hereinafter also simply referred to a light-sensitive material.

BACKGROUND OF THE INVENTION

Recently, a demand of raising processing speed of photographic light-sensitive material is increasingly strengthen accompanied with spreading of mini-labos. As to processing solution having fixing ability, a technology for accelerating processing speed by raising the concentration of thiosulfate has been proposed in, for example, Japanese Patent Publication Open to Public Inspection (hereinafter referred to JP O.P.I.) No. 2-191952/1990.

Processing methods which can be carried out with a lowered amount of processing solution are disclosed in European Patent Publication (EP) No. 559025 and JP O.P.I. No. 2-7041/1990.

However, in the processing tank of a solution having a fixing ability with a small volume, aerial oxidation of thiosulfate contained in the solution as fixing agent is easily accelerated by circulation of the solution and air brought by bubbles formed by the circulation in the presence of a surfactant which is eluted from the light-sensitive material processed. Particularly, when a small amount of light-sensitive material is processed per day, renewal of sulfite, as preservant of thiosulfate, in the solution is become insufficient and oxidation of thiosulfate is progressed without replenishing of sulfite. As a result of that, an insoluble substance composed of a decomposition product of thiosulfate is formed in the solution. The insoluble matter adheres on the surface of light-sensitive material processed and causes degradation in the image quality and lowering of the fixing ability of the solution. The insoluble substance further causes clogging of a filter connected to the processing tank.

Further, when a stabilizing tank with circulation is arranged at the position following to the processing tank of a solution having a fixing ability, the solution having a fixing ability having a lowered content sulfite content is brought in to the stabilizing solution together with the light-sensitive material and aerial oxidation of thiosulfate is considerably accelerated by the reason as above. Thus the decomposition product of thiosulfate is also tend to form easily in the stabilizing tank.

Recently, an activated processing under a high temperature and with a high concentration processing solution is often used to satisfy a demand of rapid processing. In such conditions, the decomposition of thiosulfate tend to be easily occurred.

Further, waving of the surface of a processing solution is accelerated and rise and fall of the solution surface is magnified in a processing tank having a small volume. As a result of that, the processing solution is tend to be adhered and remained on the wall of the tank. Then compositions of the remained processing solution is crystallized on the wall and the crystals are grown by capillarity. If such crystals are formed near an inlet or outlet of light-sensitive material of processing machine, scratches on the surface of the light-sensitive material often formed by the crystals, and the scratches causes serious defects on the processed light-sensitive material.

On the other hand, aerial oxidation and evaporation of the processing solution is accelerated by waving the surface of the processing solution because the area of the solution exposed to air is increased by waving. For instance, in the case of a fixing solution, the fixing solution is easily influenced by decreasing the content of sulfite by aerial oxidation and decomposition of thiosulfate or sulfurization is tend to be occurred when the amount of solution is small. Further, concentration of the solution by evaporation is easily occurred because the volume of the solution is small, and the amount of silver ion and halide ion accumulated in the solution is considerably increased. The accumulation of these ions in the solution results a insufficient fixation.

As above-mentioned, aerial oxidation of thiosulfate, crystal formation on the wall of processing tank and concentration of processing solution are easily occurred when an usual solution having a fixing ability containing a high concentration of thiosulfate is used for processing in a tank having a small volume. The above phenomena cause a serious damage on the commercial value of processed light-sensitive material.

SUMMARY OF THE INVENTION

The object of the invention is to provide a processing method for silver halide photographic light-sensitive material in which the durability of the processing solution having a fixing ability to be used is excellent and adhesion of insoluble substance composed of decomposition product of thiosulfate, formation of damage on the surface of light-sensitive material and lowering in the fixing ability of the solution are inhibited.

The object of the invention can be attained by a method for processing a silver halide photographic light-sensitive material by an automatic processor having a processing chamber, comprising the step of conveying a silver halide photographic light-sensitive material imagewise exposed to light and developed with a developer, through a chamber which is filled with a processing solution having a fixing ability, in which the processing chamber comprises an upper member constituting a upper wall of the chamber and a lower member constituting a bottom wall of the chamber and a means for conveying the light-sensitive material, and the upper wall and the bottom wall forms a small volume, and the processing solution having a fixing ability contains a fixing agent and a compound represented by the following Formula I, II, III or IV:

Formula I

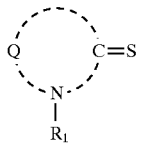

wherein Q is a group of atoms necessary to form a nitrogen-containing heterocyclic ring; and $R_1$ is a hydrogen atom, an alkyl group having 1 to 6 carbon atoms, a cycloalkyl group, an aryl group, an amino group or a heterocyclic group including one having a five- or six-member unsaturated ring condensed therewith.

Formula II

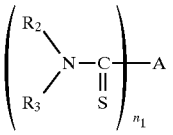

wherein $R_2$ and $R_3$ are each a hydrogen atom, an alkyl group having 1 to 6 carbon atoms, hydroxyl group, a carboxyl group, an amino group, an acyl group having 1 to 3 carbon atoms, an aryl group or an alkenyl group; A is —(C=X)—N(R)(R'), —$(CH_2)n_2$—(C=X)—N(R)(R'), —$(S)m_1$—(C=X)—N(R)(R'), —$(S)m_2$—$(CH_2)n_3$—(C=X)—N(R)(R'), —$(S)m_3$—$(CH_2)n_4$—N(R)(R'), —$(S)m_4$—N(R)(R'), —$(NH)n_5$—$(CH_2)m_5$—$(NH)n_6$—(C=X)—N(R)(R'), —S—S—(C=X)—N(R)(R'), —SZ or an $n_1$-valent heterocyclic group including one having a five- or six-member unsaturated ring condensed therewith; in which R and R' are each synonymous with $R_2$ and $R_3$; X is =S, =O or =NR"; Z is a hydrogen atom, an alkali metal atom, an ammonium group, an amino group, a nitrogen-containing heterocyclic residue, an alkyl group such as a methyl group or an ethyl group or —S—B—$Y(R_4)(R_5)$; R" is a hydrogen atom, an alkyl group having 1 to 6 carbon atoms, a cycloalkyl group, an aryl group, an amino group, or a heterocyclic residue including one having a five- or six-member unsaturated ring condensed therewith; and $n_1$ to $n_6$ and $m_1$ to $m_5$ are each an integer of 1 to 6; B is an alkylene group having 1 to 6 carbon atoms, Y is —N<, =C< or —CH<; $R_4$ and $R_5$ are each synonymous with $R_2$ and $R_3$. $R_4$ and $R_5$ each may be —B—SZ; and $R_2$ and $R_3$, and $R_4$ and $R_5$ each may be bonded together to form a ring.

Formula III

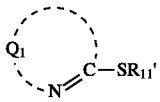

wherein $Q_1$ is a group of atoms necessary for forming a nitrogen-containing heterocyclic ring including one having a five- or six-member unsaturated ring condensed therewith; $R_{11}$' is a hydrogen atom, an alkali metal atom,

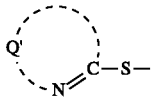

or an alkyl group; Q' is synonymous with $Q_1$.

Formula IV

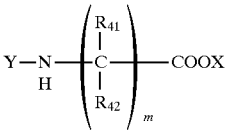

wherein X is a hydrogen atom, or an alkali metal atom; Y is a hydrogen atom or an alkyl group; m is an integer of 1 to 6; $R_{41}$ and $R_{42}$ are each a hydrogen atom, an alkyl group having 1 to 6 carbon atoms or an acyl group.

(1) The processing solution having a fixing ability contains a kind of thiosulfate and a compound represented by Formula I, II, III or IV in a ratio of 0.05 to 5% by weight of the thiosulfate.

(2) The processing solution having a fixing ability contains a compound represented by Formula III.

(3) The processing solution having a fixing ability is a fixing solution.

(4) The processing solution having a fixing ability is replenished during the course of the processing by a replenishing composition in a form of a solid.

(5) The distance between the upper wall and the bottom wall in the direction perpendicular to the surface of the light-sensitive material conveyed in the processing chamber is 3 to 200 times of the thickness of the light-sensitive material in a swollen state.

(6) The automatic processor has a circulation means for circulating the processing solution having a fixing ability through the processing chamber and a circulation channel connected with said processing chamber and said circulation means.

(7) The volume of the processing solution contained in said processing chamber $V_w$ and the volume of the processing solution contained in said circulating channel $V_f$ satisfy the relation of $V_w \leqq V_f$.

(8) The circulating rate of the processing solution in said circulation channel $V_c$ in l/min. and the volume of the processing solution contained in said processing chamber $V_w$ in l satisfy the relation of $5 \times V_w \leqq V_c \leqq 40 \times V_w$.

(9) The inlet of the processing solution to said processing chamber from said circulation channel has a form of a nozzle through which the processing solution is spouted to the surface of the light-sensitive material conveyed in the processing chamber.

(10) The circulating rate of the processing solution in said circulation channel $V_c$ in l/min. and the total of sectional area of the inlet of the processing solution to said processing chamber from said circulation channel $S_e$ in $cm^2$ satisfy the relation of $0.5 \times S_e \leqq V_c \leqq 5 \times S_e$.

DETAILED DESCRIPTION OF THE DRAWINGS

Figure 1:
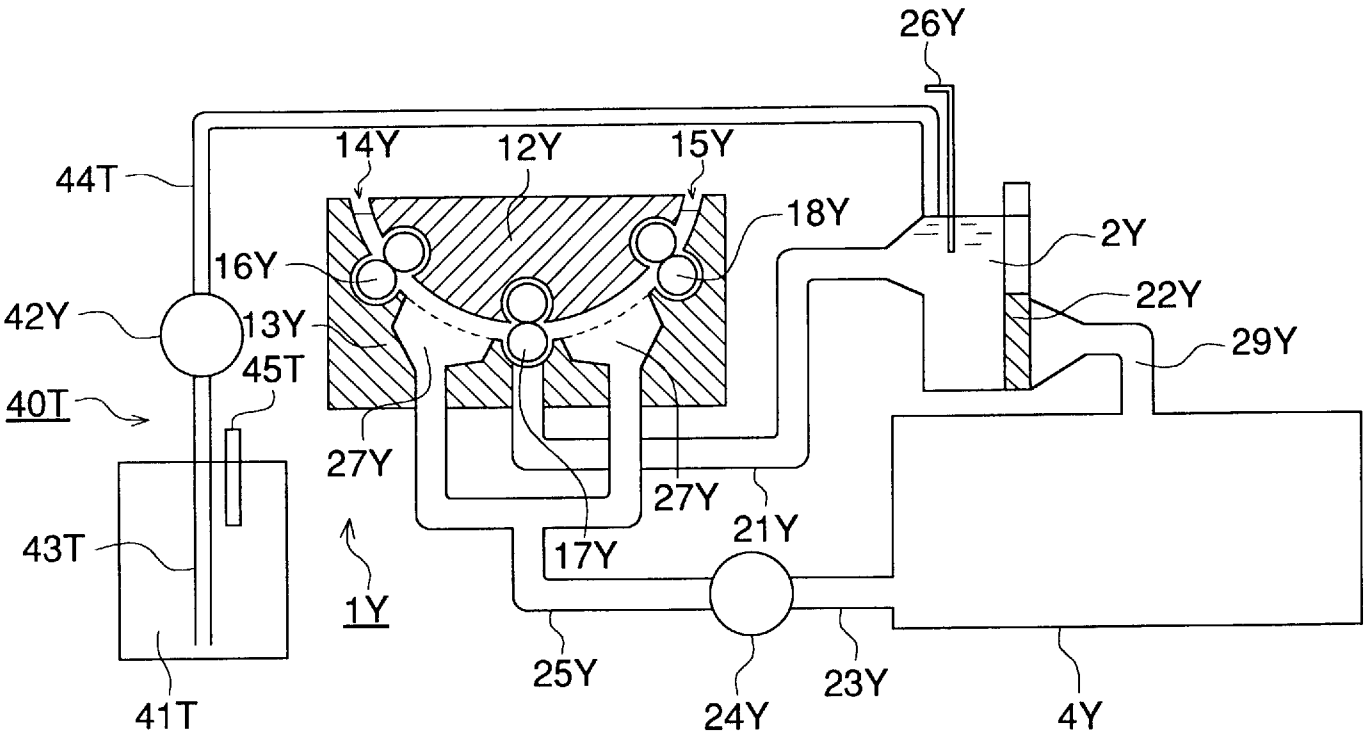
FIG. 1 shows schematic cross-section of an example of processing chamber of automatic processor for silver halide photographic light-sensitive material relating to the invention.
Figure 3A:
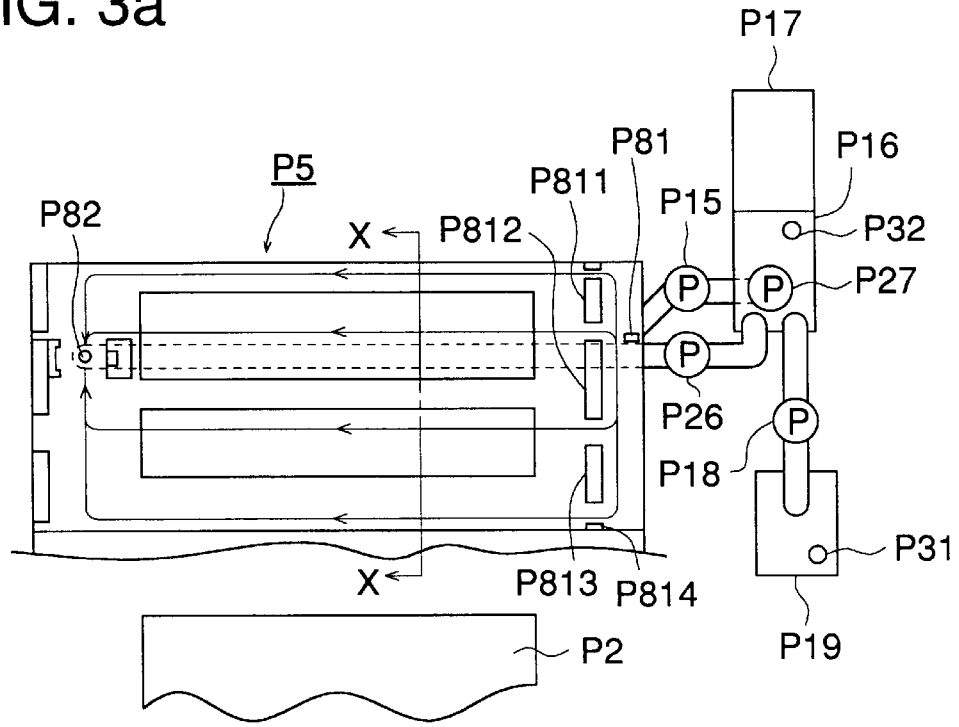

FIG. 3*a* shows a top-view of a processing chamber of the automatic processor shown in FIG. 1.

Figure 3B:
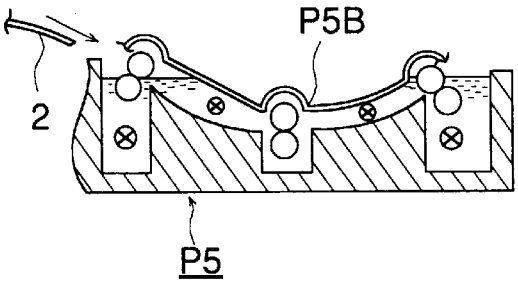

FIG. 3*b* shows a cross-section of the processing chamber of the automatic processor shown in FIG. 1.

Figure 3C:
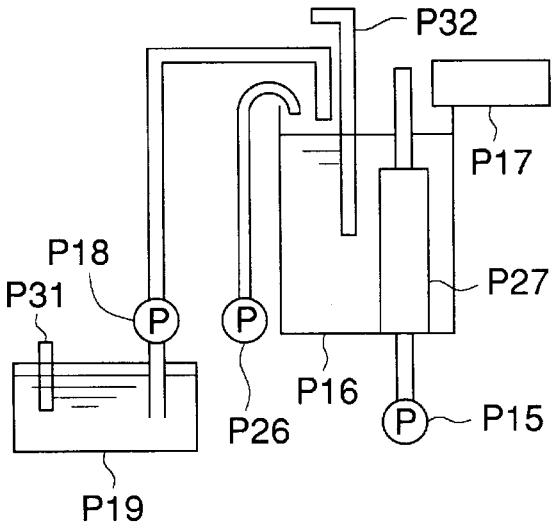

FIG. 3*c* shows a cross-section of auxiliary tank.

Figure 4:
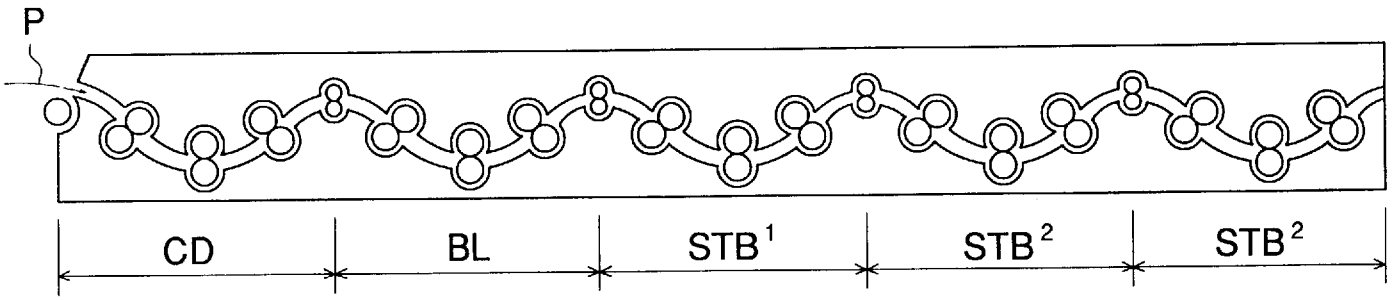

FIGS. 4 shows a cross-section of the automatic processor used in Example 4.

Figure 5A:
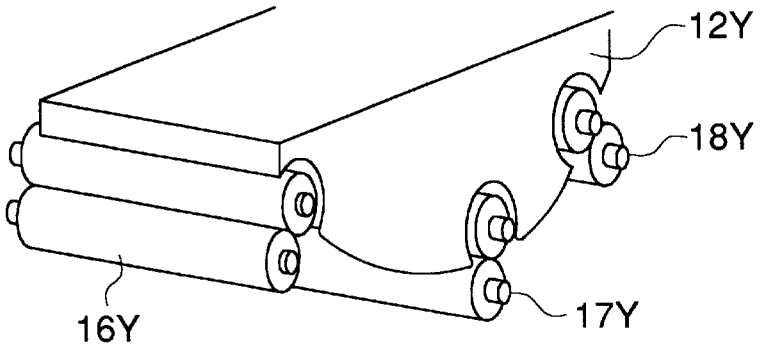
Figure 5B:
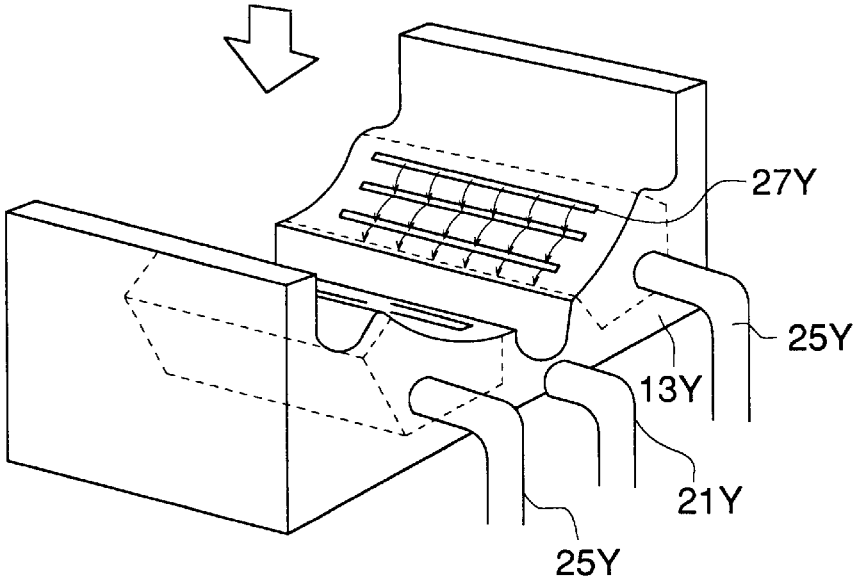
Figure 5C:
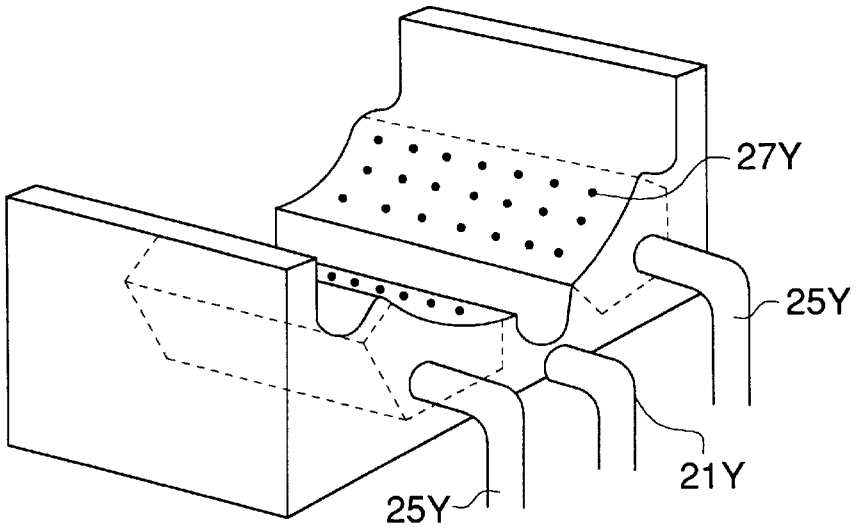

FIGS. 5*a*, 5*b* and 5*c* each shows structure of the processing chamber.

Figure 6A:
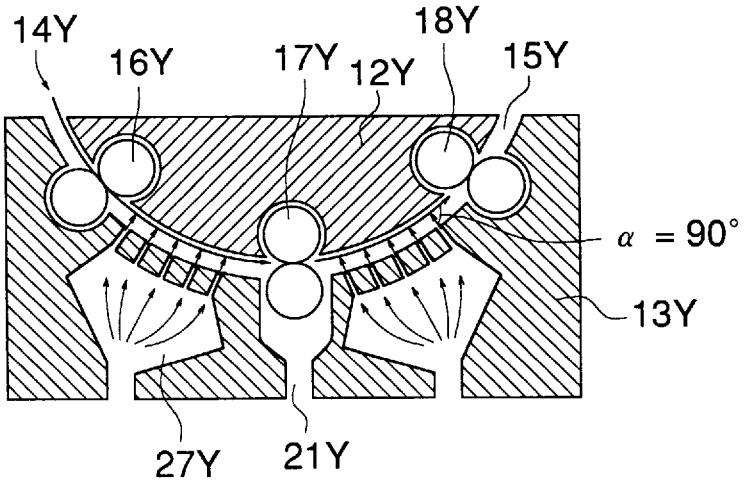
Figure 6B:
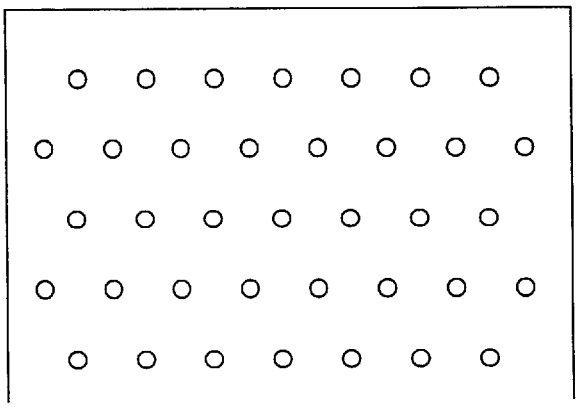

FIGS. 6*a* and 6*b* shows a cross-section of the processing chamber having nozzles and the arrangement of the nozzles in the chamber, respectively.

Figure 7:
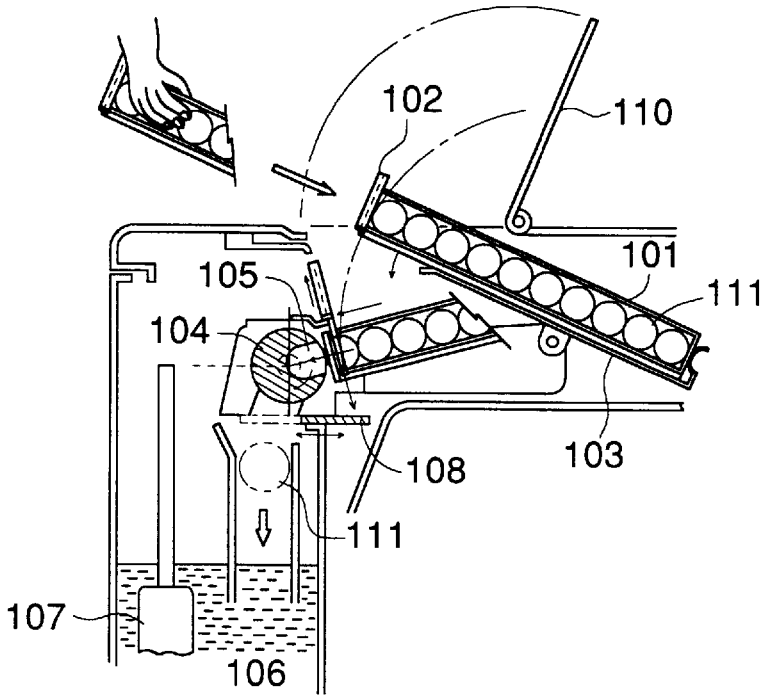

FIG. 7 shows structure of a solid processing composition supplying device.

Figure 8:
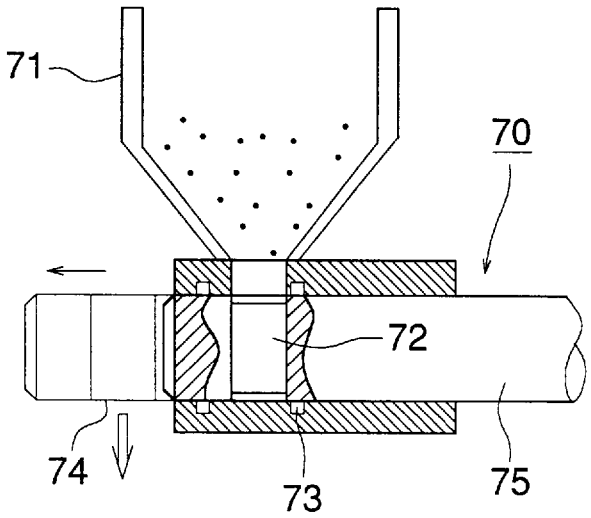

FIG. 8 shows structure of another solid processing composition supplying device.

DETAILED DESCRIPTION OF THE INVENTION

The automatic processor used in the invention is characterized in that the processing with a processing solution having a fixing ability is carried out in a tank or processing chamber having a small volume. In the above, the volume of processing chamber is a volume of space between the upper wall of the chamber constituted by a upper member such as a upper conveying rack and the bottom wall of the chamber or a bottom conveying rack constituted by a lower member, and "small volume" means a volume of the processing chamber of not more than 10 liter for a light-sensitive material having a large width. The volume of the processing chamber is preferably 0.3 to 5 liter more preferably 0.5 to 3 liter. Hereinafter, the processing chamber having such a small volume relating to the invention is referred to "a processing chamber" or simply "a chamber".

The volume of chamber can be made small when the shape of the chamber is in a form prolonging along the conveying direction of light-sensitive material in the processing chamber in which the processing solution is existed only at the portion near the conveying light-sensitive material. In this case, the volume of the chamber can be made further small, when a part of the inner wall of the chamber is made to have a role of conveying guide for the light-sensitive material. The light-sensitive material can be smoothly conveyed in such a chamber and jamming of the light-sensitive material and deterioration of the processing by oxidation at the time of repair of jamming can be also avoided.

Although the processing chamber having a small volume is used as a fixing chamber or bleach-fixing chamber in the invention the small volume chamber can also be used as a chamber for another processing step.

In the processing chamber having a shape prolonged along the conveying direction of the light-sensitive material, it is preferred that the ratio of the volume B (liter) of the chamber having a small volume to the area of light-sensitive material conveying in the chamber ST ($m^2$), B/ST, is not more than 200, more preferably not more than 100.

In the invention, the distance from the upper wall of to the bottom wall of the processing chamber in the direction perpendicular for the surface of the light-sensitive material processed in the chamber is preferably 3 to 200 times, more preferably 30 to 150 times, of the thickness of the light-sensitive material in a swollen state. When the ratio is less than 3 times, the space for conveying the light-sensitive material is insufficient for smooth conveying of light-sensitive material. On the other hand, the ratio is 200 times or more, the volume of processing solution contained in the chamber becomes too large and degradation of the processing solution by air oxidation is increased.

In the above, the "distance from the upper wall to the bottom wall of the processing chamber" is distance between the upper wall and the bottom wall of the chamber, at the portion in which the light-sensitive material is conveyed, in the direction perpendicular to the surface of the light-sensitive material to be processed in the chamber. The distance between the upper and bottom wall may not be the same at the all portion of the chamber. When the distance is different by portion of the chamber, the distance is defined by that at the portion at which the distance between the upper wall and the bottom wall is largest. The thickness of light-sensitive material in a swollen state is the total thickness of the support and that of layers provided on the support of the light-sensitive material in the state of swollen in the processing solution, which can be determined by a swelling degree measuring apparatus manufactured by Sinko Denki Co., Ltd. The thickness of light-sensitive material in the swollen state is commonly approximately 200 $\mu$m in the case of color negative film even though the thickness is varied according to the kind of light-sensitive material and the processing solution. Accordingly, the distance from the upper wall to the bottom wall of the processing chamber is preferably within the range of from 0.6 mm to 40 mm, more preferably 6 mm to 30 mm.

It is preferred in the invention that the processing chamber has a circulation means for circulating the processing solution having a fixing ability for improving the fixing ability of the processing.

In the invention, from the viewpoint of improving the processing ability and inhibiting the aerial oxidation of the processing solution in the circulation chamber, it is preferred that the condition of $V_W \leqq V_f$ is satisfied, namely, the volume of processing solution in the processing chamber is smaller than the volume of the solution contained in the external circulation channel of the solution.

Moreover, the processing property can be more stably maintained by carrying out the processing under a condition satisfying the equation of $5\times V_W \leqq V_C \leqq 40\times V_W$, in which $V_C$ (l/min.) is a circulating rate of the processing solution and $V_W$ (l) is a volume of the processing solution. A satisfactory proceeding rate of processing without unevenness in the processing can be attained by satisfying the condition of $5\times V_W$, and aerial oxidation of the processing solution contained in the processing chamber can be inhibited and, as the result of that, formation of insoluble substance of decomposition product and formation of scratches on the light-sensitive material caused by the insoluble substance and lowering of processing rate can be prevented by satisfying the condition of $V_C \leqq 40\times V_W$, preferably $V_C \leqq 20\times V_W$.

Effects of the invention can be further enhanced when the above $V_C$ (l/min.) and the sum of the cross section area of the inlet of circulating processing solution to the processing chamber $S_e$ ($cm^2$) satisfy the following relation:

$$0.5\times S_e \leqq V_C \leqq 5\times S_e.$$

In the above, "the sum of the cross section area of the inlet $S_e$" means the total of the area of inlet of processing solution through which the processing solution is supplied into the processing chamber. When the inlet is in a form of nozzle-shape having multi-holes or slits, $S_e$ represents the total of opening area thereof.

A condition satisfying the relation of $S_e \leqq V_c$, and a condition satisfying the relation of $V_C \leqq 3\times S_e$ are particularly preferable. Effects of the circulation cannot be effective and processing rate is perhaps lowered when the condition of $0.5\times S_e \leqq V_C$ is not satisfied. On the other hand, when the relation of $V_C \leqq 5\times S_e$ is not satisfied, difference of the fixing rate at the portion of the light-sensitive material to which the processing solution is directly spouted and at the portion to which the processing solution is not directly spouted are made larger and unevenness of composition of the processing solution is raised so unevenness of processing is perhaps occurred.

It is preferred that the inlet of the circulating processing solution to the processing chamber is formed into a nozzle through which the processing solution is spouted to the surface of light-sensitive layer of the light-sensitive material. The spouting rate of the processing solution to the surface of light-sensitive material can be increased by using such nozzle-shape inlet of the solution. As a result of that, the penetration of the composition of the processing solution into the light-sensitive layer is accelerated and the processing can be sufficiently proceeded. It is preferred that the nozzle is formed in a shape of multiple holes or a slit, and that the flowing direction of the processing solution spouted from the nozzle meets at an angle of from 30° to 150° with the direction of conveying direction of the light-sensitive material. The processing rate is considerably raised by setting the nozzle as above-mentioned, it is supposed that the acceleration of processing rate is caused by the reason of that an product inhibiting the processing reaction formed near the surface of the light-sensitive material is flown-off by the stream of the processing solution spouted from the nozzle.

The diameter of the hole of multi-hole type nozzle is preferably with in the range of from 0.5 mm to 5 mm, and the width of the slit of slit type nozzle is preferably within the range of from 0.5 mm to 5 mm.

A plurality of the nozzles may be arranged to form two or more lines which are set in the direction to be in parallel with the surface of conveying light-sensitive material to be processed and perpendicular to the conveying direction of the light-sensitive material, and the lines of nozzles are arranged so that the phase of the nozzle positions in one of the lines and that in an adjacent line is staggered. Streak-shaped unevenness in the fixation in the direction of the conveying the light-sensitive material can be prevented by the above-mentioned arrangement of the nozzles.

The effect of the invention can be enhanced by distributing the inlets or spouting nozzles through which the processing solution is supplied into the processing chamber, so as to be over almost all area of the processing chamber of the light-sensitive material.

The opening ratio N ($cm^2/l$), i.e., ratio of the surface area opening to air to the volume of the processing solution, is preferably not more than 12. The opening ratio N is a ratio of $S_t/V_t$, in which $S_t$ and $V_t$ are the total area of the era-liquid interface in $cm^2$ and the total volume in liter of the solution having a fixing ability contained in the processing chamber and a portion connected to the chamber such as the circulation channel, respectively. Air oxidation of the processing solution can be inhibited by making the ratio to 12 or less.

The amount of the processing solution, $V_c$ in terms of l/min., circulating through the circulation channel of the processor is preferably made to variable according to the operating condition of the processor. In the such processor, the processing ability can be raised when the light-sensitive material is processed in the processing chamber by increasing the circulation amount of the processing solution. On the other hand, when no light-sensitive material is processed and water or a replenisher of the processing solution is only supplied, concentration unevenness in the processing solution can be prevented by lowering circulation amount of the processing solution so as to inhibit oxidation of the processing solution. For making variable the circulating amount of the processing solution according to the operating condition of the processor, for example, a propeller type pump having a variable speed propeller blades is usable as the circulation means for the processing solution.

The processor may have a structure in which an inter-chamber conveying rollers are provided at an interposition between the processing chamber of the processing solution having a fixing ability and a chamber of the following processing, through which the light-sensitive material to be processed is conveyed to the following processing chamber, and replenishing water is supplied toward the inter-chamber conveying rollers. In a processor having the above-mentioned structure, the processing solution adhered on the inter-chamber rollers is washed off by the replenishing water supplied on the rollers and formation of crystals and insoluble substance on the rollers can be prevented when without daily removal and washing of the rollers by an operator. Further a stable processing can be performed by the processor having such the structure since the formation of crystals and insoluble substance on the rollers and the degradation of image quality at a lower density portion of the image caused by oxidation of thiosulfate and decreasing in the amount of thiosulfate are prevented.

The processor may be structured so that a upper member, which substantially shields the processing solution from air and has an inlet and outlet for the light-sensitive material, forms a part of the processing chamber. In the processor having the such structure, the aero-liquid interface of the processing solution is substantially removed, except the portion of the inlet and outlet of the chamber, because the processing solution is shielded from air by the upper member. As a result of that oxidation of thiosulfate can be remarkably inhibited since the area of aero-liquid interface of the processing solution contained in the processing chamber is considerably decreased by the use of the upper member having the above-mentioned structure. Further, the maintenance of the interior of the processing chamber can be easily carried out when the upper member is removably mounted to the processing chamber. It is further preferred that the upper member has a packing member at the portion at which the upper member fixed with the processing chamber for preventing an escape of the processing solution caused by waving the solution surface.

The processor may have a movable shielding means at the inlet of the light-sensitive material to substantially shield the processing solution in the processing chamber from air when no light-sensitive material is passed through the inlet. In the processor having such structure, the aero-liquid interface of the processing solution contained in the processing chamber is considerably decreased and air oxidation and evaporation of the processing solution can be considerably inhibited since the processing solution is shielded from air at the portion of the inlet.

It is preferred that the inter-chamber conveying rollers which convey the light-sensitive material from a processing chamber to the following processing chamber is composed of a pair of rollers facing to each other. The inter-chamber rollers having such structure can be washed by a washing means having a simple structure.

Water formed by a means for separating water from moist gas attached to the processor can be used as at least a part of replenishing water supplied from a water supplying means. In this way, the amount of the supplying water can be reduced. As the means for separating water from moist gas, a dehumidifier available in the market or a device condensing moisture in a gas by a heat pump or an electronic cooling element such as Pertier element is usable. A device in which water vapor separated from gas by a semi-permeable membrane is also usable.

When the water supplying means is constructed so that replenishing water is supplied from a replenishing water tank in which replenishing water is stored and water separated by the water separating apparatus is introduced into the water tank, water can be supplied little by little to the water tank during a prolonged period from the apparatus for separating water from moist gas.

Compound represented by Formula I, II, III or IV to be used in the invention are described below.

In Formula I, Q is a group of atoms necessary to form a nitrogen-containing heterocyclic ring, including ones having a five- or six-member unsaturated ring condensed therewith, such as imidazoline ring, thiazoline ring or triazoline ring; and $R_1$ is a hydrogen atom, an alkyl group having 1 to 6 carbon atoms, a cycloalkyl group, an aryl group, a heterocyclic group including one having a five- or six-member unsaturated ring condensed therewith, such as a pyridinyl group, imidazolyl group or a thiazolyl group.

In Formula II, $R_2$ and $R_3$ are each a hydrogen atom, an alkyl group having 1 to 6 carbon atoms, a hydroxyl group, a carboxyl group, an amino group, an acyl group having 1 to 3 carbon atoms, an aryl group or an alkenyl group such as an allyl group or a butenyl group. A is —(C=X)—N(R)(R'), —$(CH_2)n_2$—(C=X)—N(R)(R'), —$(S)m_1$—(C=X)—

N(R)(R'), —(S)$m_2$—($CH_2$)$n_3$—(C═X)—N(R)(R'), —(S)$m_3$—($CH_2$)$n_4$—N(R)(R'), —(S)$m_4$—N(R)(R'), —(NH)$n_5$—($CH_2$)$m_5$—(NH)$n_6$—(C═X)—N(R)(R'), —S—S—(C═X)—N(R)(R'), —SZ or an $n_1$-valent heterocyclic group, including one having a five- or six-member unsaturated ring condensed therewith, such as a pyridine ring residue, an imidazole ring residue or a thiazole ring residue, in which R and R' are each synonymous with $R_2$ and $R_3$; X is ═S, ═O or ═NR"; Z is a hydrogen atom, an alkali metal atom, an ammonium group, an amino group, a nitrogen-containing heterocyclic residue such as a pyridine ring residue or an imidazole ring residue, an alkyl group such as a methyl group or an ethyl group, or —S—B—Y($R_4$)($R_5$); R" is a hydrogen atom, an alkyl group having 1 to 6 carbon atoms, a cycloalkyl group, an aryl group, a heterocyclic residue, including one having a five- or six-member unsaturated ring condensed therewith, such as a pyridine residue, an imidazole residue, or an amino group; and $n_1$ to $n_6$ and $m_1$ to $m_5$ are each an integer of 1 to 6. B is an alkylene group having 1 to 6 carbon atoms, Y is —N<, ═C< or —CH<; $R_4$ and $R_5$ are each synonymous with $R_2$ and $R_3$. $R_4$ and $R_5$ each may be —B—SZ; and $R_2$ and $R_3$, and $R_4$ and $R_5$ each may be bonded together to form a ring.

In formula III, $Q_1$ is a group of atoms necessary to form a nitrogen-containing heterocyclic ring, including one having a five- or six-member unsaturated ring condensed therewith, such as a thiazole ring, thiadiazole ring, an imidazole ring, a pyrimidine ring, a triazole ring, a pyradine ring a triazine ring or an oxadiazole ring, among them thiazole ring, thiadiazole ring imidazole ring and triazole ring are preferable and triazole ring is particularly preferable; and $R'_{11}$ is a hydrogen atom, an alkali metal atom, a group formed by releasing a hydrogen atom from a compound represented by Formula III or an alkyl group such as a methyl group or an ethyl group.

In Formula IV, X is a hydrogen atom, an alkali metal atom; Y is a hydrogen atom, or an alkyl group which may have a substituent; and m is an integer of 1 to 6. $R_{41}$ and $R_{42}$ is a hydrogen atom, an alkyl group having 1 to 6 carbon atoms or an acyl group, the alkyl group and the acyl group may have a substituent.

Examples of compounds represented by Formula I, II, III, or IV are shown below.

(I-1)

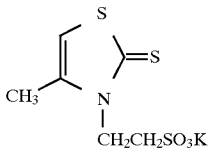

(I-2)

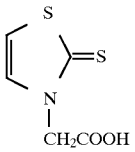

(I-3)

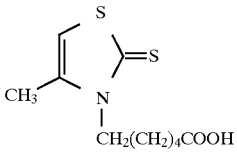

-continued (I-4)

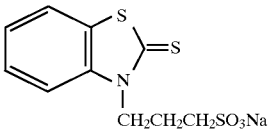

(I-5)

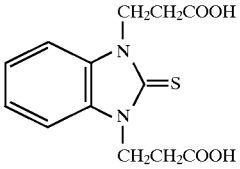

(I-6)

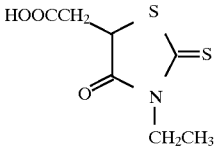

(I-7)

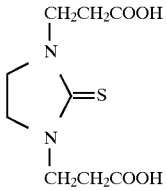

(I-8)

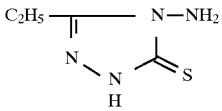

(I-9)

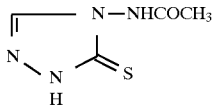

(I-10)

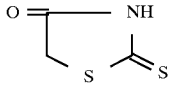

II-1

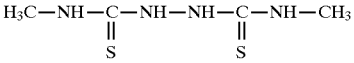

II-2

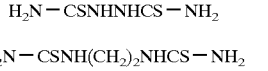

II-3

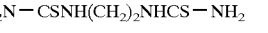

II-4

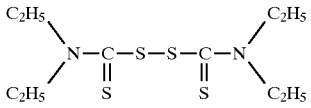

II-5

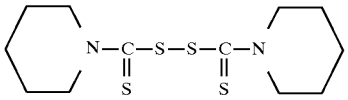

II-6

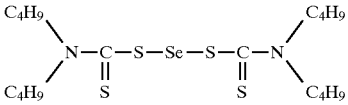

II-7

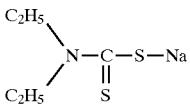

-continued
II-8
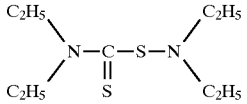
II-9
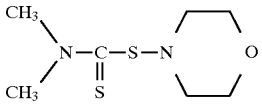
II-10
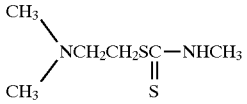
II-11
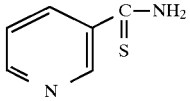
II-12
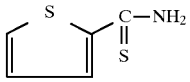
II-13
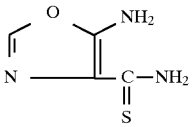
II-14
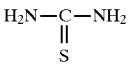
(III-1)
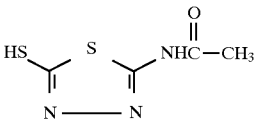
(III-2)
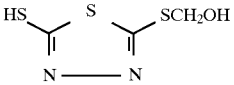
(III-3)
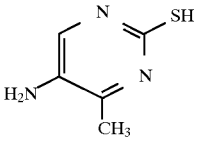
(III-4)
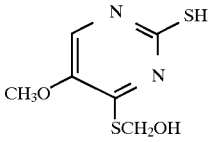
(III-5)
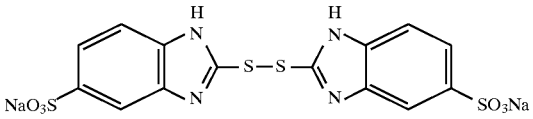
(III-6)
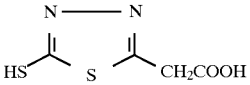
(III-7)
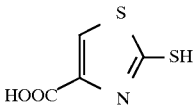
-continued
(III-8)
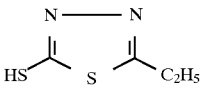
(III-9)
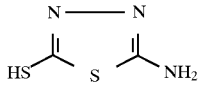
(III-10)
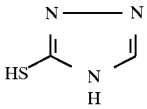
(III-11)
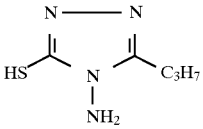
(III-12)
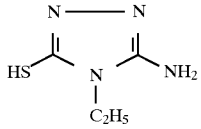
(III-13)
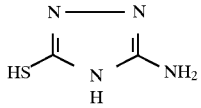
(III-14)
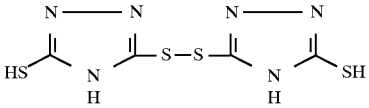
(III-15)
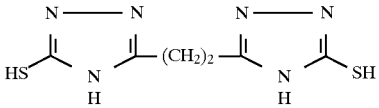
(III-16)
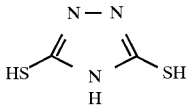
(III-17)
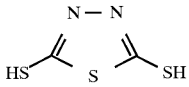
(III-18)
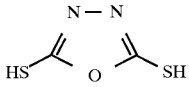
(III-19)
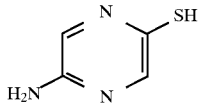
(III-20)
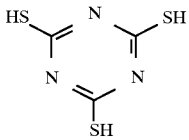

-continued (III-21)

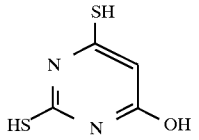

(III-22)

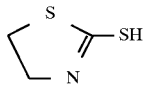

(III-23)

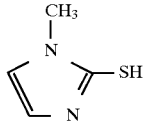

(III-24)

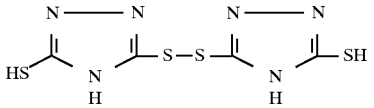

(III-25)

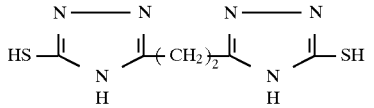

IV-1

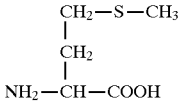

IV-2

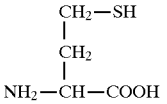

IV-3

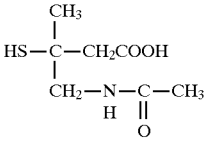

IV-4

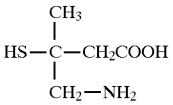

IV-5

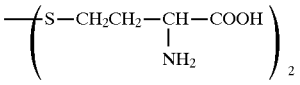

IV-6

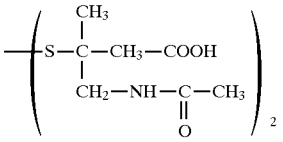

Among the above exemplified compounds, I-2, II-2, III-9, III-10, III-13, III-22, IV-1, IV-3 and IV-5 are cited as ones preferably used from the viewpoint of the effects of the invention. Compounds represented by Formula III or IV are particularly preferred and examples of them include III-10, III-13 and IV-1.

Formation of insoluble substance in the fixing chamber, or bleach-fixing chamber and the first stabilizing chamber can be prevented by adding a compound of the invention represented by Formula I, II, III or IV even when a small amount of light-sensitive material is processed per day. It is supposed that such the effect of the compound is caused by the fact that the compound concerns to the formation reaction of the insoluble substance composed of decomposition products silver ions and thiosulfate ions because the interaction between the compound and silver ion is very strong.

The concentration of thiosulfate necessary to complete the fixing reaction can be reduced by the presence of at least one of the compounds of the invention in the processing solution having a fixing ability. Precipitation and adhesion of the decomposition products of thiosulfate in the chamber of the processing solution having a fixing ability and in the chamber following thereto can be prevented and the fixing property can be stably maintained by the reduction in the thiosulfate concentration in the above-mentioned way, It is preferred that the compound of the invention is applied to a fixing solution for enhancing the effects of the invention from the view point of the stability of the compound.

The effects of the invention can be enhanced by setting the amount of the replenishing solution to the fixing solution to not more than 800 ml/$M^2$ of the light-sensitive material to be processed.

Under a usual condition, the fixing property of the solution is tend to rapidly degrade by accumulation of silver ions and halogen ions in the fixing solution when the replenishing amount is 800 ml/$M^2$ or less. In the present invention, the processing ability of the fixing solution can be realized with out degradation by adding the compound of the invention to the fixing solution even when the amount of the replenishing solution is not more than 800 ml/$M^2$.

In the invention, the amount of the replenishing solution is preferably 30 to 700 ml/$M^2$, more preferably 50 to 500 ml/$m^2$.

When the replenishing composition is supplied in a solid form, the above "amount of replenishing solution" to be read as "amount of replenishing water". The amount of replenishing water is difference of the total volume of the replenishing solution and that of the solid composition to be dissolved therein.

In the invention, the ratio of the weight of at least one of the compounds represented by Formula I, II, III or IV to that of thiosulfate is preferably 0.05 to 5%, more preferably 0.2 to 2%. by weight from the viewpoint of avoiding crystal formation under a low-temperature condition.

Although silver halide usable in the light-sensitive material to be processed by the method of the invention includes silver chloride, silver chlorobromide, silver bromide, silver iodobromide and silver iodide, a liver halide light-sensitive material suitable for taking photograph is preferred, which comprises silver iodobromide having a relatively high silver iodide content, 5 mole % or more.

A fixing agent is essential in the fixing solution or bleach-fixing solution of the invention.

As the fixing agent, a compound capable of forming a water soluble complex with silver halide, for example, a thiosulfate such as potassium thiosulfate, sodium thiosulfate or ammonium thiosulfate; a thiocyanate such as potassium thiocyanate, sodium thiocyanate or ammonium thiocyanate; or a thiouera ether are described.

The fixing solution or bleach-fixing solution may contains one or more pH-buffer agents such as boric acid, borax, potassium hydroxide, sodium hydroxide, potassium carbonate, sodium bicarbonate, potassium bicarbonate, acetic acid, sodium acetate and ammonium hydroxide, further to the above-mentioned thiosulfate. Further, a compound known as a usual additive for the fixing solution or bleach-fixing solution, for example, a pH-buffer such as borate, oxalate, acetate, carbonate or phosphate, an alkylamine or a polyethyleneoxide may be optionally added to the solution of the invention.

Although the above-mentioned thiosulfate is used in an amount of not less than 0.1 moles per liter of the solution, it is preferred to enhance the effects of the invention to be used 0.6 to 4 moles, more preferably 0.6 to 4, further preferably 0.9 to 3.0 moles, particularly preferably 1.1 to 2.0 moles per liter.

In the invention, air or oxygen may be blown into the processing tank or storage tank of replenisher solution for raising activity of the fixing or bleach-fixing solution according to necessity. Hydrogen peroxide, a bromate or a persulfate may be optionally added to the solution for the same purpose.

The fixing solution and bleach-fixing solution of the invention is preferably used within the pH range of 4 to 8.

It is preferred that the fixing or bleach-fixing solution of the invention contains a sulfite or a compound capable of releasing a sulfite ion such as potassium sulfite, sodium sulfite, ammonium sulfite, ammonium hydrogen sulfite, potassium hydrogen sulfite, sodium hydrogen sulfite, potassium metabisulfite, sodium metabisulfite or ammonium metabisulfite. The compound includes those represented by the following Formula B-1 or B-2.

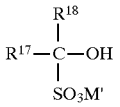

Formula B-1

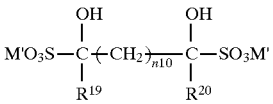

Formula B-2

In the above Formulas, $R^{18}$ is an alkyl group having 1 to 5 carbon atoms; $R^{18}$ is an alkyl group which may have a substituent; M' is an alkali metal atom, $R^{19}$ and $R^{20}$ are each a hydrogen atom or an alkyl group having 1 to 5 carbon atoms which may have a substituent; and $n_{10}$ is an integer of 0 to 4.

Examples of the compounds represented by the above Formulas B-1 or B-2 are described below.

B-1 Formaldehyde-sodium bisulfite

B-2 Acetaldehyde-sodium bisulfite

B-3 Propionic aldehyde-sodium bisulfite

B-4 Butyldehyde-sodium bisulfite

B-5 Succinic aldehyde-sodium bisulfite

B-6 Glutaraldehyde-sodium bisulfite

B-7 Formaldehyd-bis-sodium bisulfite

B-8 β-methyl glutaraldehyde-bis-sodium bisulfite

B-9 Maleic aldehyde-bis-sodium bisulfite

The above sulfite or compound capable of releasing sulfite ion is preferably contained in the fixing solution or bleach-fixing solution in an amount of not less than 0.1 moles per liter, more preferably 0.12 to 0.55 moles per liter, further preferably 0.15 to 0.50 moles per liter, and particularly preferably 0.20 to 0.40 moles per liter, in terms of moles of sulfite ion. The fixing solution or bleach-fixing solution usable in the invention may contains a sulfinic acid derivative.

In the processing according to the invention, silver may be recovered from the processing solution having a fixing ability by any method known in the field of the art. For example, an electrolysis method described in French Patent No. 1,299,667, a precipitation method described in JP O.P.I. No. 52-73037/1977 and German Patent No. 2,331,220, exchange method described in JP O.P.I. No. 51-17114/1976 and German Patent No. 2,548,237 and a metal exchange method described in British Patent No. 1,353,805 are effectively applied.

The processing solution having a fixing ability is returned to the processing chamber after the silver recovering process. An antioxidation agent such as a sulfite may be added to the solution before returning.

A washing chamber and a stabilizing chamber used in the invention is described below. Although a stabilizer replenisher may be replenished to the stabilizing solution, a method may be applied, in which a solid stabilizer replenishing composition is directly supplied to the stabilizing chamber together with replenishing water.

Although the washing chamber or the stabilizing chamber may be sued solely, the number of the chamber may be increased to 2 to 10 for reducing the replenishing amount of water or stabilizing solution. The preferable number of the chamber is 2 to 6 from the view point of the compactness of the processor.

Although washing water or a stabilizing solution, or a tablet of stabilizer composition and replenishing water when a solid processing composition is used, may be separately supplied at plural positions in the course of these processing, it is preferred to use a multi-step counter-current method in which washing water or the stabilizing solution is supplied to a chamber arranged at lower reaches of the processing flow of the light-sensitive material, and the solution overflowed from the chamber (including the case in which the solution is flown thorough a pipe connection the tank and a tank the solution is introduced therein) is introduced into a chamber arranged at the upper reaches of the processing flow. A cascade method is one of the above counter-current method. It is preferable for enhancing the effects of the invention that the processor to be used in the invention has two or more stabilization chambers and a stabilizer replenishing solution, preferably a solid composition of stabilizer replenisher and water, is supplied to the chamber arranged at the last position and the solution overflowed from the chamber is introduced into a chamber arranged at a previous position in the sequence of processing chambers.

The fixing or bleach-fixing process of the invention may be carried out by using one or plural chambers. When plural fixing or bleach-fixing cambers are used, it is preferred that a replenishing solution is supplied to the chamber arranged at the last position and the solution overflowed from the last chamber is introduced into a previous chamber. The solution introduced into the bleach-fixing chamber may be a solution composed of a mixture of a solution overflowed from the bleach-fixing chamber and a solution overflowed from the fixing chamber. In this case, these chambers preferably arranged in the order of bleaching chamber, bleach-fixing chamber and fixing chamber.

Various type of liquid pumps can be used in the processor relating to the invention for circulating the processing solution. Among them, a bellows pump such as those of KB or KBM series manufactured by Iwaki Co., Ltd., a perister pump such as those of SJ series manufactured by Ato Co., Ltd., an electromagnetic pumps such as those of EX and EX-E series manufactured by Kobayashi Rika-kiki Co., Ltd. and Daiiti Kagaku Co., Ltd. are preferably used.

It is preferred that a waste liquid concentrating apparatus is linked with the processor to be used in the invention. The amount of waste liquid can be considerably reduced by the use of such apparatus. Further, the amount of water to be replenished to a replenishing water tank can be reduced by using distilled water formed from the concentration apparatus as the replenishing water, and the working amount of the worker can be also reduced.

The liquid concentrating apparatus is preferably constructed so that the distilled water formed in the course of concentration of the waste liquid can be recycles as water for processing use. As the concentration apparatus, an evaporating concentration apparatus using a method of distillation under a reduced pressure is preferable. A heat pump or Pertier element is suitable for the heating means for evaporation. The evaporation is preferably carried out at a temperature of not higher than 60° C., and under a pressure not higher than 200 mmHg, more preferably 100 mmHg. Decomposition and evaporation of compositions contained in a waste solution can be avoided by carrying out the concentrating operation using the above-mentioned apparatus under the conditions. Thus distilled water can be reused for processing without generation of any harmful gas or bad smell. As the means for pressure reducing, a vacuum pump, or an ejector is suitably used. The ejector is preferred in the reason of a lowered level of noise, compactness and high efficiency thereof.

Although a solid processing composition may be supplied to any portion of a processing course, it is preferable that the solid composition is supplied to a portion which is connected to a processing chamber and is constructed the processing solution is flown through the portion and the chamber. Further the portion where the solid processing composition to be supplied is constructed so that a certain amount of the processing solution is circulated through the processing chamber and a dissolved ingredient of the solid composition is moved to the processing chamber.

The processing solution is thermally conditioned with an electric heater. In a practical processor, a heat exchanging means and a heater are attached at a processing chamber and an auxiliary tank connected to the processing chamber, and a pump is arranged so as to circulate a certain amount of the solution through the chamber and to maintain the temperature of the solution at a prescribed value.

Further a filter is usually arranged in the above circulation channel of the processing solution for precipitated remove crystalline substance.

It is most preferable way that a solid processing composition is supplied to a position where is thermally conditioned and connected to the processing chamber such as above-mentioned auxiliary tank, because an insoluble substance contained in the solid processing composition is removed from the processing solution by the filter, and adhesion of the insoluble substance flown into the processing chamber on the processed light-sensitive material can be prevented.

As the material of the filter of filtering apparatus usually used in the field are usable without any limitation. The any specific structure or material of the filtering means do not influence on the effects of the invention.

A tank for storing the replenishing solution can be eliminated by directly supplying the solid processing composition to the circulation channel of the solution. The elimination of the replenisher storage tank is advantageous to make compact the processor. Further dissolution of the solid composition is improved when the composition is directly supplied to the circulation channel of the processing solution.

Preferable concrete processing procedures relating to the invention are as follows:

(1) Color developing→Bleaching→Fixing→Washing→

(2) Color developing→Bleaching→Fixing Washing→Stabilizing (3) Color developing→Bleaching→Fixing→Stabilizing (4) Color developing→Bleaching→Fixing $1^{st}$ stabilizing→$2^{nd}$ stabilization (5) Color developing→Bleaching→Bleach-fixing→Washing (6) Color developing→Bleaching→Bleach-fixing→Washing→Stabilizing (7) Color developing→Bleaching→Bleach-fixing→Stabilizing (8) Color developing→Bleaching→Bleach-fixing→$1^{st}$ stabilizing→$2^{nd}$ stabilizing (9) Color developing→Bleaching→Bleach-fixing→Fixing→Washing→Stabilizing

(10) Color developing→Bleaching→Bleach-fixing→$1^{st}$ stabilizing→$2^{nd}$ stabilizing Among the above procedures, (3), (4), (7), and (10) are preferred, and (3), (4) and (7) are particularly preferred.

A bleaching solution or bleach-fixing solution to be used in the invention may be contains a ferric complex of a compound represented by the following Formula K.

It is preferred that the ferric complex of a compound is a ferric complex of an aminopolycarbonic acid represented by Formula K in a free acid state. It is more preferred that the ferric complex is used together with a free aminopolycarbonic acid. It is further preferable that the ferric complex is used in combination with a aminopolycarbonic acid the same as that constituting the ferric complex. A hydrated ferric complex of the aminopolycarbonic acid may be used in a form of salt such as a potassium salt, a sodium salt or an ammonium salt and the free aminopolycarbonic acid may be used in a form such as a free acid, a potassium salt or a sodium salt.

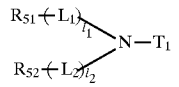

Formula K

In the formula, $T_1$ is a hydrogen atom, a hydroxyl group, a carboxyl group, a sulfo group, a sulfamoyl group, a sulfonamido group, an acylamino group, phosphono group, an alkyl group which may have a substituent, an alkoxy group, a hydroxamic group, a hydroxyl group, alkyl group or

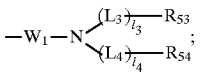

in which $W_1$ is an alkylene group, an arylene group, an alkenylene group, a cycloalkylene group, an aralkylene group, the above groups represented by $W_1$ each may have a substituent, or $-(L_5-X)_{l+di\ 5}-(L_6)_{l+di\ 6}$; in which X is —O—, —S—, a di-valent heterocyclic ring or

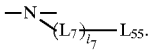

$R_{55}$ through $R_{55}$ are each a hydrogen atom, a hydroxyl group, a carboxyl group, a sulfo group, a carbamoyl group, a phosphono group, sulfamoyl group, sulfonamido group, an acylamino group or a hydroxamic group, and at least one of $R_{51}$ through $R_{55}$ is a carboxyl group.

$L_1$ through $L_7$ are each an alkylene group, an arylene group, an alkenylene group, a cycloalkylene group or an aralkylene group, the above groups represented by $L_1$ through $L_7$ each may have a substituent, $l_1$ through $l_7$ are each an integer of 0 to 6 provided $l_5$ and $l_6$ are not 1 at the same time.

Examples of the aminopolycarbonic acid represented by Formula K constituting the ferric complex of aminopolycarbonic acid are shown below.

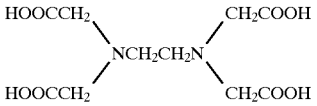
K-1
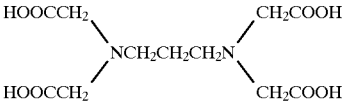
K-2
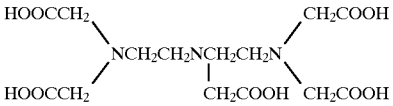
K-3
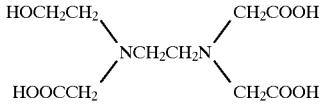
K-4
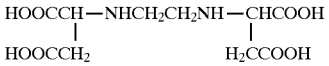
K-5
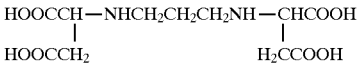
K-6
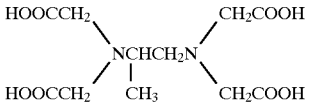
K-7
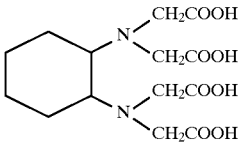
K-8
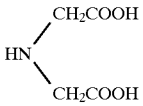
K-9
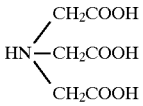
K-10
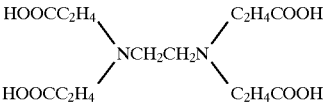
K-11
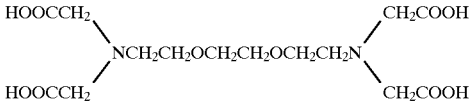
K-12
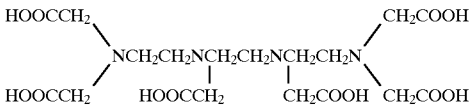
K-13
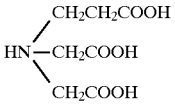
K-14
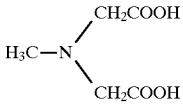
K-15
-continued
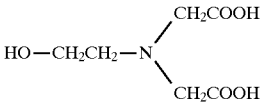
K-16
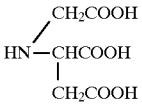
K-17
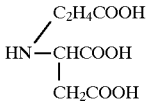
K-18
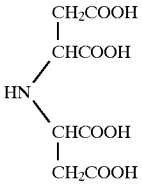
K-19
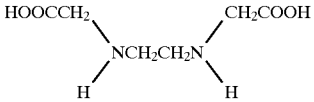
K-20
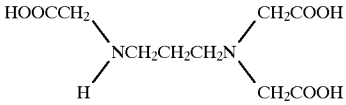
K-21
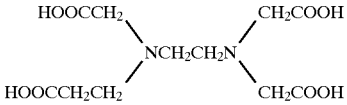
K-22
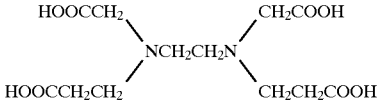
K-23
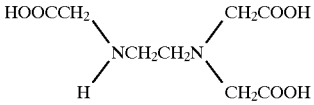
K-24
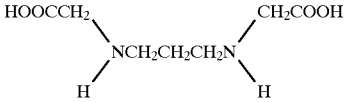
K-25
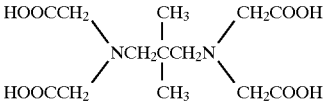
K-26
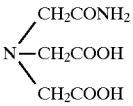
K-27
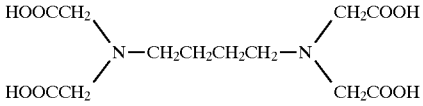
K-28

-continued

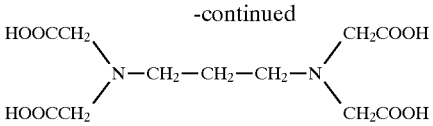

K-29

Some of the above compounds, K-5, K-6, K-7, and K-17 to K-19, have an asymmetric carbon atom and several stereoisomers exist as to each of the compound. Each of the compound may contain any stereoisomers thereof with any content may be used. When the aminopolycarbonic acid is a tridentate ligand, a preferable iron complex thereof is one formed with $Fe^{3+}$ (III) ion in a ratio of 1:2. Preferable compounds to be used in a bleaching solution or bleach-fixing solution usable in the invention include K-1 to K-9, K-12, K-14 to K-20, K-22, K-23 and K-27, more preferably K-1 to K-6, K-9 and K-14 to K-17, particularly preferably K-1, K-3, K-5 and K-17.

In the invention, it is preferred that the composition for preparing the processing solution having a fixing ability is in a form of solid for improving a preservability. A solid processing composition usable in the invention includes a powdered, granulated and tableted composition. Among them, the granulated and tableted composition are preferred for avoiding dust formation. The tableted composition is most preferred to enhance the effect of the invention.

In the above, the powdered composition is a mass of fine crystals of components. The granulated composition is components in a form of granule having a diameter of 50 to 5000 $\mu$m, which is preferably prepared by granulating the powdered composition. The tableted composition is one formed by pressing the powder or granules of the composition to a prescribed form. It is preferred that the tableted composition is prepared by tableting the previously prepared powdered or granulated composition since the tableted composition thus prepared is effective to obtain a stable photographic property.

As the method for preparing the granules for forming a tablet, well known methods such as a rotating granulation method, extrusion granulation method, crushing granulation method, stirring granulation method, fluidized layer granulation method and spray-drying granulation method can be applied. The average size of the thus formed granules is preferably 100 to 2000 $\mu$m, more preferably 200 to 1500 $\mu$m, because uneven distribution of components at the time of mixing and compression is hard to occur by using such a size of granules. It is preferred that the granules is have a size distribution such as 50% by weight of the granules included in the deviation of ±250 $\mu$m. Thus formed granules can be used as the granulated processing composition. For compressing the granulated composition, a known compressing machine such as an oil press machine, single tableting machine, rotary tableting machine or precketting machine can be used. Moreover, the granulated composition prepared as above may be mixed and tableted with a raw crystal of a component available on the market. Although the solid form processing composition may be formed in any shape by compression, a cylindrical form or tablet form is preferable from the view point of that the producibility and handling ability are high, and powder dust formation is small at the time of practical use.

The solid processing composition for preparing the processing solution having a fixing ability usable in the invention contains a thiosulfate such as ammonium thiosulfate, potassium thiosulfate or sodium thiosulfate. It is preferred that the amount of sodium thiosulfate occupies 2 to 70% by weight, particularly 5 to 20% by weight of the total amount of thiosulfates contained in the composition.

Further to thiosulfate, the fixing solid composition may contains components for constituting a fixing composition, such as a sulfite, bisulfite, sulfite adduct, meso-ion compound, thioether compound, chelating compound, non-ionic or anionic surfactant and buffer agent. The bleach-fixing solid composition may contains a component for constituting a bleach-fixing composition further to the above components for fixing composition, such as a halide salt, a known ferric salt of organic acid, for example a ferric complex of aminopolycarbonic acid, solid organic acid and anti-mold agent.

Decomposition of thiosulfate during the storage and powdering caused by friction after the storage in the solid processing composition are considerably inhibited by containing at least one of polyethylene glycols, polyvinylpyrrolydones, polyvinyl alcohols and sugars.

Among them, a polyethylene glycol represented by the following Formula V is preferably used.

$$HO—(A)n_1—(B)n_2—(D)n_3—H \qquad \text{Formula V}$$

In the formula, A, B and C are each respectively $—CH_2CH_2O—$, $—CH_2CH(R)O—$ or $—CH_2CH_2CH_2—$ or $—CH_2CH(R)CH_2O—$. R is an alkyl group having 1 to 6 carbon atoms such as methyl group, ethyl group or propyl group, which may have a substituent, or a hydroxyl group. $n_1$, $n_2$ and $n_3$ are each zero or an integer of 1 to 500. The average molecular weight of the compound is preferably within the range of 2000 to 20000. The sugar includes monosaccharides and polysaccharides which is composed of a plurality of monosaccharide moleculars bonded each other by glycoside bonding. The monosaccharide is general term of polyhydroxy aldehydes, polyhydroxy ketones and various derivatives thereof including reduced derivatives, oxidized derivatives, deoxy derivatives, amino derivatives and thio derivatives. Although many kinds of sugar are represented by a formula of $C_nH_{2n}O_n$, the sugars usable in the solid processing composition include compounds derived from the compound having the skeleton of the formula. Among the monosaccharides, sugar alcohols is preferred, which is formed by reducing an aldehyde group or ketone group of the sugar to a primary of secondary alcohol group and hexitoles having six carbon atoms are particularly preferred.

The polysaccharides include cellulose, starch and glycogen. The cellulose include derivatives such as cellulose ethers in which all or a part of hydroxyl groups of the cellulose is etherized, and the starches include dextrin which is composed of various hydrolized products of starch including maltose. The cellulose derivatives may be in a form of alkali metal salt which have high water solubility. The cellulose and dextrin are preferred among the polysaccharides.

The adding amount of the sugars to the solid processing composition is 0.5% to 30% by weight, preferably 1.0% to 20% by weight, of the solid processing composition.

The sugars widely exist in nature and available on the market and the various derivative thereof can easily be prepared by applying a reduction, oxidation or dehydrizing reaction.

Compounds represented by Formula V, polyvinylpyrrolidones, polyvinyl alcohols and sugars may be used in a form of powder of raw materials, mixture of granulated granules, or granules granulated with thiosulfate.

Formation of the sulfurized substance and formation of powder after storage under a high temperature condition of the tableted composition are further inhibited by adding a sulfite of pyrosulfite to the composition. As the sulfite or pyrosulfite, ammonium salt, sodium salt and potassium salt thereof are usable. Among them sodium salt and potassium salt are preferred.

EXAMPLES

Example 1

The experiments with respect to fixing process using a fixing composition are carried out by a processing chamber shown in FIG. 1.

The structure of the processing chamber shown in FIG. 1 is described below.

Processing chamber 1Y for processing a silver halide photographic light-sensitive material comprises a lower member 13Y which constitutes the bottom wall of the chamber and defines the shape of the bottom of the processing chamber along the conveying course of the light-sensitive material to be processed and also functions as a conveying guide for the light-sensitive material at the bottom of the chamber; a top member 12Y which constitutes the upper wall of the chamber and defines the shape of the upper side of the processing chamber along the conveying course of the light-sensitive material to be processed and also functions as a tope side conveying guide for the light-sensitive material: and pairs of conveying roller 16Y, 17Y and 18Y which convey the light-sensitive material to be processed along the conveying course thereof provided between the bottom member 13Y and the top member 12Y. The processing chamber is filled with a processing solution and aero-liquid interfaces of the processing solution in the channel 1Y are only formed at an inlet 14Y and outlet 15Y which are each an opening between the bottom member 13Y and the top member 12Y. Further, an inter-channel conveying guide contacted to the top member 12Y and a pair of inter-channel conveying roller are arranged at the down stream side of the light-sensitive material conveyance of the outlet of the processing chamber, though they are not drawn in FIG. 1.

A side of the processing chamber 1Y, an auxiliary tank 2Y is separately provided and the processing chamber 1Y is connected to the bottom portion of the auxiliary tank 2Y with a circulation pipe 21Y so as to circulate the processing solution between the processing chamber and the auxiliary tank.

A rod-shape heater 26Y is attached through the upper wall of the auxiliary tank 2Y so as to immerse in the processing solution in the auxiliary tank. The heater maintains the processing solution in the processing chamber and the circulation channel at a temperature suitable for processing carried out in the processing chamber, for example 20° to 55° C., according to the information from a thermometer provided in the auxiliary tank 2Y, the thermometer is not drawn in the figure.

In the auxiliary tank 2Y, a filter 22Y is exchangeably attached so as to across the auxiliary tank 2Y and circulation pipe 29Y which is connected to a storage tank of the processing solution 4Y. The filter 29Y functions to removed an insoluble substance such as a precipitated substance from the processing solution. The lower portion of the auxiliary tank 2Y is connected by the circulation pipe 29Y to the upper portion of the storage tank 4Y. The processing solution storage tank 4Y is connected to an inlet of circulating means or circulation motor 24Y by a circulation pipe 23Y which is provided through the wall at lower portion of the storage tank 4Y and connected to the inlet of the circulation motor.

As above-mentioned, the circulation system of the processing solution is constituted by the processing chamber 1Y the auxiliary tank 2Y, circulation pipe 29Y, processing solution storage tank 4Y, circulation pump 24Y and circulating pipe 25Y. The terminal of circulation pipe 25Y other than that connected to the outlet of the circulation pump 24Y is connected to a nozzle 27Y through which the processing solution is spouted into the processing chamber in the direction across the conveying direction of the light-sensitive material. In the above-mentioned construction, the processing solution is sucked from the auxiliary tank 2Y and is spouted into the processing chamber Y1 and returned to the auxiliary tank 2Y when the circulation pump 24Y is driven, thus the solution is circulated.

Figure 2:
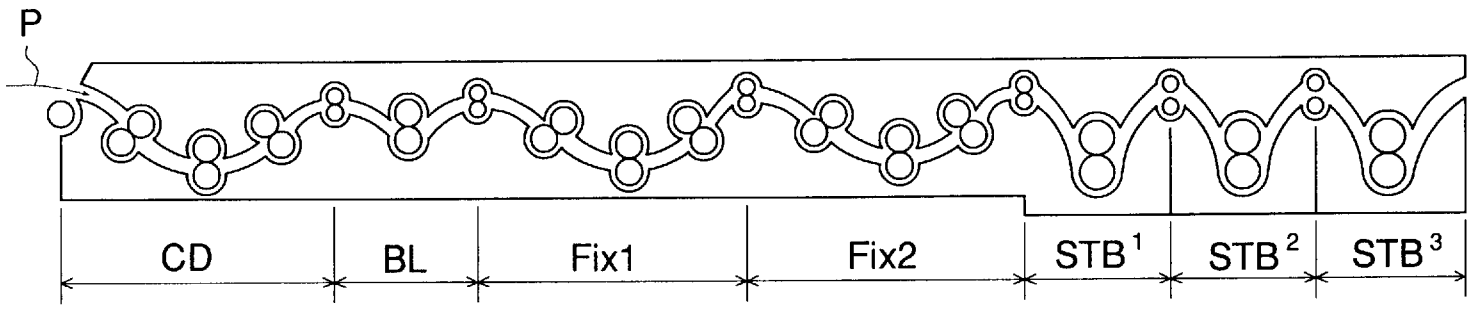
FIG. 2 shows a cross-section of the automatic processor used in Example 1.

FIG. 2 is a schematic drawing showing a cross section of a part of an automatic processor in the conveying direction of light-sensitive material to be processed therein. The processor is constructed by connecting a plurality the processing chambers shown in FIG. 1. In the processor, the processing chambers are arranged in the order of, from the left side of the drawing, a color developing chambers CD, a bleaching chamber BL, first and second fixing chambers Fix 1 and Fix 2 and first to third stabilizing chambers STB-1, STB-2 and STB-3 to make a line along the conveying direction of the light-sensitive material P. These chambers are each filled with a color developer, a bleaching solution, a fixing solution and a stabilizing solutions, respectively. The processor is constructed so that the photographic material to be processed P is conveyed from the inlet of the processor by conveying rollers according to the course represented by the chain line in the drawing. The processing solutions are filled in each chambers so that the surface of each of the solutions are to be almost the same level.

Processing chambers of the processor are constructed in an unit as above-mentioned so that the height of the processor is considerably smaller than that of an usual automatic processor. The processing chambers are each covered with an upper member so that the opening area of the processing solution and the volume of the processing chamber can be made small. The upper members each define the shape of the upper wall of the respective processing chambers and form the conveying course of the light-sensitive material.

In the processor used in the examples, the processing solution was flowed in the direction perpendicular to the drawing, though which is not shown in FIG. 2. The flowing status of the processing solution is shown in the drawing of fixing chamber FIG. 3 as an example of the processing chamber. FIG. 3*a* is a top view of one of the fixing chambers of the processor and the lines each marked with an arrow shows principal flow lines of the fixing solution. The fixing solution is spouted from the outlet P81 of pump 15, which is means for forming stream and circulating the processing solution, and is passed through opening portion P811, P812, P813 and P814 to form a high speed stream. The stream of the solution is flowed to left side of the drawing and is sucked into the outlet opening P82 provided at the left end of the chamber in the drawing. A pump P26 is connected to the opening P82 to suck the processing solution. The solution sucked by the pump P26 is returned to an auxiliary thank P16 through a pipe. The processing solution returned to the auxiliary tank P16 is filtered through a filter P27 and is returned to the processing chamber by the pump P15.

FIG. 3*b* shows a cross sectional view of the fixing chamber of FIG. 3*a* at the portion of line X—X. Two rectangles drawn in the vicinity of the center of FIG. 3*a* are, as is understood by FIG. 3*b*, the bottom wall surfaces of the fixing chamber which functions as guide plate guiding the light-sensitive material P2. The processing solution is spouted through the openings P811 to P814 in the direction across the conveying direction of the light-sensitive material or the direction perpendicular to the drawing surface. Accordingly, in the case of fixing chamber, fixing reaction is accelerated by the flow of the solution formed in the processing area between the inlet side conveying rollers R6 and the outlet side conveying rollers R8.

A sucking opening P82 provided at a bottom portion of the processing chamber is connected with a circulating pump P26 through a pipe, and the pump P26 is connected with an auxiliary tank P16 through a pipe. The auxiliary tank p16 is connected with a circulation pump P15 through a pipe, and the pump P15 is connected with a outlet opening to the processing chamber P81 through a pipe. The circulation pumps P26 and P15 are each a pump for continuously circulating the processing solution, and the circulating amount of the solution by the pump is controllable within the range of 0.25 to 25 l/min. An overflow outlet is provided to the processing chamber, and the processing solution overflowed from the chamber is accumulated in an exhausted solution tank. The circulation pump P15 is controlled in accordance with processing conditions of the light-sensitive material and those of supplying a solid processing composition to the auxiliary tank P16. For instant, the pump is controlled so as to decrease the circulation of the processing solution when the light-sensitive material is not present in the processing chamber and to increase the circulation rate when a solid processing composition is added to the solution for accelerating dissolving of the composition. In the processing chamber, a liquid surface sensor is provided for sending information of the surface position in the tank to the controlling means of the processor. The circulation pump P26 is controlled in accordance with the information of the position of the surface of the processing solution in the chamber sent from the sensor and the driving condition of the circulation pump P15 to kept the position of the solution surface in the processing chamber at an adequate position.

In the examples, parameters regarding the processor were as follows. The volume of the fixing solution $V_w$ contained in the fixing chambers, Fix 1 and Fix 2, was 0.5 l. the volume of the fixing solution contained in the circulation channel $V_f$ was 2.5 l, the circulation rate of the fixing solution circulated by the pumps P15 and P16, $V_c$, was 5 l/min., the sum of the cross section area of the inlet for the fixing solution of the processing chamber $S_t$, which is corresponding to the total cross section area of the openings P811, P812, P813 and P814, was 4.25 $cm^2$, and the ratio of opening are to air of the processing solution N was 8 $cm^2$/l.

FIG. 3*c* shows the auxiliary tank P16. A water supplying rank P19 for storing water to be supplied to the auxiliary tank P16 is connected to the auxiliary tank P19. The water supplying tank P19 has a heater and a thermal sensor for controlling temperature of water stored in the tank at a prescribed level. The temperature was controlled in the later-mentioned examples at 38°±1° C.

A rod heater P32 is provided to the auxiliary tank P16 through the upper wall of the tank so as to immerse in the processing solution in the tank. The heater warms the fixing solution contained in the processing chamber and the circulation channel to a temperature to be suited for processing, for example 20° to 55° C., according to information a temperature sensor attached to the auxiliary tank P16, the temperature sensor is not drawn in FIG. 3*c*.

A exchangeable cylinder-shaped filter P27 is provided at the auxiliary tank P16 so as to connect with the pipe connecting the lower portion of the tank P16 with the circulation pump P15. The filter functions to remove an insoluble substance such as a precipitation.

The above-mentioned processor is referred to Processor 1 and a processor for color negative film CL-KP-50QA manufactured by Konica Corporation used for comparison is referred to Processor 2. The comparative Processor 2 has ordinary type processing tanks, the shape of which do not meet with that of the present invention.

The processing conditions are as follows:

| Processing step | Processing Time | Processing Temp | Replenishing amount |
|---|---|---|---|
| Color developing | 3 min. 15 sec. | 38° C. | 520 ml/$m^2$ |
| Bleaching | 45 sec. | 38° C. | 100 ml/$m^2$ |
| Fixing-1 | 45 sec. | 38° C. | |
| Fixing-2 | 45 sec. | 38° C. | 730 ml/$m^2$ |
| Stabilizing-1 | 20 sec. | 38° C. | |
| Stabilizing-2 | 20 sec. | 38° C. | |
| Stabilizing-3 | 20 sec. | 38° C. | 860 ml/$m^2$ |
| Drying | 80 sec. | 55° C. | |

The fixing and stabilization processes were carried out by means of a counter-current method of Fixing-2 to Fixing-1, and Stabilizing-3 to Stabilizing-2 and Stabilizing-2 to Stabilizing-1. An aeration treatment was applied to the bleaching solution by an air pump.

The solutions filling the processing chambers and tanks at the start of the processing were each prepared by using the replenishing solution and the starter of Processing Chemicals CNK-4-52 for Konica Color Negative Film, manufactured by Konica Corporation.

Two series of processing were carried out each using the above-mentioned Processors 1 and 2. Each of the processing was continuously carried out for three weeks using 15 rolls per day of Konica Color Negative Film LV100, 24 Exp. each imagewise exposed.

After the continuous processing for three weeks, a piece of unexposed film was processed. The amount of silver remained in thus processed unexposed film was determined by fluorescent X-ray method. On the other hand, appearance in the fixing chamber and the first stabilizing chamber, Fix 1, after continuous processing was visually observed. Results of the observation were ranked according to the following standard. Results of the experiments were listed in Table 1.

Appearance in the first fixing chamber Fix 1

A: No precipitation is observed.

B: Although floatings are found a little, no precipitation is observed. No problem is raised in practical use.

C: Precipitation and floatings are observed.

D: Floatings and precipitation adhered on the wall of the chamber near the solution surface are observed.

The following solutions were used as replenishing solutions.

| (Color developer replenisher for color negative film) | |
|---|---|
| CD-4 | 6.0 g |
| Hydroxylamine sulfate | 6.9 g |
| Pineflow (a hydrolysis product of dextrin | 0.4 g |

-continued

| | |
|---|---|
| manufactured by Matsutani Kagaku Co., Ltd.) | |
| Sodium 1-hydroxyethane-1,1-disulfonate | 1.5 g |
| Potassium sulfite | 7.3 g |
| Potassium carbonate | 35 g |
| Sodium hydrogen carbonate | 0.3 g |
| Sodium bromide | 0.4 g |
| Mannitol | 2.2 g |
| Polyethylene glycol 6000 | 0.5 g |
| Sodium N-myristoylalanine | 0.2 g |

-continued

| | |
|---|---|
| Water to make | 1 liter |

(Bleaching solution replenisher for color negative film)

| | |
|---|---|
| Ammonium ferric 1,3-propanediamine-tetraacetate monohydrate | 175 g |
| 1,3-propanediaminetetraacetic acid | 2 g |
| Pineflow | 27.2 g |
| Succinic acid | 133 g |
| Potassium bromide | 200 g |
| Potassium sulfate | 66.7 g |
| Potassium hydrogen carbonate | 60 g |
| Mannitol | 8 g |
| Sodium N-lauroylsarcosine | 6 g |
| Water to make | 1 liter |

(Fixing solution replenisher-1 for color negative film)

| | |
|---|---|
| Sodium thiosulfate | 25 g |
| Ammonium thiosulfate | 225 g |
| Sodium sulfite | 18 g |
| Potassium carbonate | 2 g |
| Di-sodium ethylenediaminetetraacetate | 2 g |
| Pineflow | 7 g |
| Additive (described in Table 1) | 2.5 g |
| Water to make | 1 liter |

(Fixing solution replenisher-2 for color negative film)

| | |
|---|---|
| Sodium thiosulfate | 17.5 g |
| Ammonium thiosulfate | 157.5 g |
| Sodium sulfite | 18 g |
| Potassium carbonate | 2 g |
| Di-sodium ethylenediaminetetraacetate | 2 g |
| Pineflow | 7 g |
| Additive (described in Table 1) | 1.75 g* |
| Water to make | 1 liter |

-continued

*: When 2 kinds of additives were used, 0.875 g of each of the additives are used, respectively.

(Stabilizing solution replenisher for color negative film)

| | |
|---|---|
| m-Hydroxybenzaldehyde | 1.5 g |
| Sodium laurylsulfate | 0.2 g |
| Di-sodium ethylenediainine-tetraacetic acid | 0.6 g |
| Lithium hydroxide monohydrate | 0.7 g |
| Pineflow | 0.1 g |
| Water to make | 1 liter |

TABLE 1

| Experiment No. | Processor | Additive | Fixer replenisher | Thiosulfate concentration (g/l) | Remained silver (mg/100 cm$^2$) | Appearance in 1st fixing chamber | Note |
|---|---|---|---|---|---|---|---|
| 1-1 | 2 | None | 2 | 250 | 1.27 | A | Comp. |
| 1-2 | 2 | None | 1 | 175 | 13.42 | A | Comp. |
| 1-3 | 2 | None | 2 | 250 | 0.44 | D | Comp. |
| 1-4 | 2 | None | 1 | 175 | 5.28 | D | Comp. |
| 1-5 | 1 | I-2 | 1 | 175 | 0.41 | A | Inv. |
| 1-6 | 1 | II-2 | 1 | 175 | 0.43 | A | Inv. |
| 1-7 | 1 | III-10 | 1 | 175 | 0.13 | A | Inv. |
| 1-8 | 1 | III-13 | 1 | 175 | 0.21 | A | Inv. |
| 1-9 | 1 | III-22 | 1 | 175 | 0.20 | A | Inv. |
| 1-10 | 1 | IV-1 | 1 | 175 | 0.38 | A | Inv. |
| 1-11 | 1 | IV-3 | 1 | 175 | 0.36 | A | Inv. |
| 1-12 | 1 | III-10 | 2 | 175 | 3.19 | A | Comp. |
| 1-13 | 1 | III-10 & IV-1 | 1 | 175 | 0.16 | A | Inv. |

Comp.: Comparative
Inv.: Inventive
*: Ratio of the distance between the upper wall to bottom wall of the processing chamber (D) to the thickness of the light-sensitive material in a swollen state (T).

As is understood from the data of Table 1, the fixation of the color film is completely performed when the fixing solution and the processing chamber are used in combination according to the invention. Further, it is established that the concentration or using amount of thiosulfate in the fixing solution can be reduced by the use of the compound of the invention.

Example 2

In this example, a bleach-fixing solution is used as the processing solution having a fixing ability of the invention. The automatic processor used in this example was prepared by modifying the Processor 1 used in Example 1 so as to be suitable for processing a color photographic paper, which was referred to Processor 3. As is shown in FIG. 4, in this processor, the processing chambers are arranged in the order of, from the left side of the drawing, a color developing chambers CD, a bleach-fixing chamber BF and first to third stabilizing chambers STB-1, STB-2 and STB-3 to make a line along the conveying direction of the light-sensitive material P. The photographic material is transported and processed in this order. An usual automatic processor for color photographic paper NP818 manufactured by Konica Corporation was used for comparison, which is referred to Processor 4. The comparative Processor 4 has ordinary type processing tanks, the shape of which do not meet with that of the present invention.

Konica Color QA Paper Type A6 manufactured by Konica Corporation was processed in a rate of 10 m$^2$ per day by the both of Processors-3 and -4. The processing was continued for one month. The test results were evaluated in the same manner as in Example 1. Thus obtained results are listed in Table 2. The Processing conditions applied in the test were the followings.

| Processing step | Processing Time | Processing Temp | Replenishing amount |
|---|---|---|---|
| Color developing | 22 sec. | 39.5° C. | 70 ml/m$^2$ |
| Bleach-fixing | 22 sec. | 38.0° C. | 90 ml/m$^2$ |
| Stabilizing-1 | 22 sec. | 35–38° C. | |
| Stabilizing-2 | 22 sec. | 35–38° C. | |
| Stabilizing-3 | 22 sec. | 35–38° C. | 180 ml/m$^2$ |
| Drying | 50 sec. | | |

The stabilizing process carried out by a counter-current method from stabilizing-3 to -2, and stabilizing-2 to -1. The amount of carry-over was 50 ml per square meter of the color paper for all processing chambers.

The processing solutions filling the processing chambers at the starting time of the processing were prepared using Color Developer 28P-1 for Konica Color QA Paper and Color Developer Starter 28P-1S, Bleach-fixer Starter 28P-2 for Konica Color QA Paper, and Stabilizer Starter 28P-3 for Konica Color QA Paper, each manufactured by Konica Corporation.

The followings were used as replenishing solutions.

| (Color developer replenisher for color paper) | |
|---|---|
| Di-sodium salt of disulfoethylhydroxylamine | 4 g |
| Sodium paratoluenesulfonate | 30 g |
| Cinopal SFP (Ciba-Geigy) | 3 g |
| Cinopal SFP | 1.5 g |
| Sodium sulfite | 3 g |
| Zinc sulfate heptahydrate | 0.2 g |
| Di-sodium ethylenediaminetetraacetate | 1.5 g |
| Ammonium sulfate | 2 g |
| o-phenylphenol | 0.1 g |
| Pineflow | 0.25 g |
| Sodium N-lauroylsarcosine | 0.1 g |
| Water to make | 1 liter |

TABLE 2

| Experiment No. | Processor | Additive | Remained silver (mg/100 cm$^2$) | Appearance in bleach-fixing chamber | Note |
|---|---|---|---|---|---|
| 2-1 | 4 | None | 0.92 | B | Comparative |
| 2-2 | 3 | None | 0.28 | D | Comparative |
| 2-3 | 3 | I-2 | 0.05 | A | Inventive |
| 2-4 | 3 | II-2 | 0.05 | A | Inventive |
| 2-5 | 4 | III-10 | 0.54 | A | Comparative |
| 2-6 | 3 | III-10 | 0.04 | A | Inventive |
| 2-7 | 3 | III-13 | 0.04 | A | Inventive |
| 2-8 | 3 | III-22 | 0.05 | A | Inventive |
| 2-9 | 3 | IV-1 | 0.05 | A | Inventive |
| 2-10 | 3 | IV-3 | 0.05 | A | Inventive |

Test results given in Table 2 show that the processing ability is raised by the use of the processing chamber according to the invention but the storage ability of the developer is degraded. Excellent processing ability and storability of the bleach-fixing solution can be obtained only when the processing chamber and the compound specified in the invention are used in combination.

Example 3

The following experiments were carried out in the same manner as in Example 1 except that the distance between the upper member 12Y and the bottom member 13Y is changed as shown in Table 3, and the volume of the processing solution contained in the processing chamber and the circulation channel was varied by changing the shape of the lower member 13Y and the processing solution storage tank 4Y as shown in Table 3, and the additive is changed to III-10. The replenisher solution-2 was used in the experiments. Results of the experiments are listed in Table 3.

TABLE 3

| Experiment No. | Additive | D/T* | Volume of solution in processing chamber | Volume of solution in circulation channel | Remained silver (mg/100 cm$^2$) | Appearance in fixing chamber | Note |
|---|---|---|---|---|---|---|---|
| 3-1 | None | 100 | 0.5 | 2.5 | 5.28 | C | Comp. |
| 3-2 | III-10 | 2 | 2.5 | 0.5 | 0.69 | B | Inv. |
| 3-3 | III-10 | 2 | 0.5 | 2.5 | 0.52 | B | Inv. |
| 3-4 | III-10 | 3 | 2.5 | 0.5 | 0.48 | B | Inv. |
| 3-5 | III-10 | 3 | 0.5 | 2.5 | 0.29 | A | Inv. |
| 3-6 | III-10 | 100 | 2.5 | 0.5 | 0.41 | B | Inv. |
| 3-7 | III-10 | 100 | 1.75 | 1.25 | 0.35 | B | Inv. |
| 3-8 | III-10 | 100 | 1.5 | 1.5 | 0.28 | A | Inv. |
| 3-9 | III-10 | 100 | 0.5 | 2.5 | 0.13 | A | Inv. |
| 3-10 | III-10 | 200 | 2.5 | 0.5 | 0.45 | B | Inv. |
| 3-11 | III-10 | 200 | 0.5 | 2.5 | 0.39 | A | Inv. |
| 3-12 | III-10 | 220 | 2.5 | 0.5 | 0.65 | B | Inv. |
| 3-13 | III-10 | 220 | 0.5 | 2.5 | 0.58 | B | Inv. |

*: D/T is a ratio of the distance between the upper wall and the bottom wall of the bleach-fixing chamber and the thickness of the light-sensitive material in a swollen state.
Comp.: Comparative
Inv.: Inventive From the above results, it is understood that the sufficient processing ability and storing ability can be obtained when the relation of $V_w \leqq V_f$ is satisfied. Further, it is advantageous that the distance between the upper wall and the bottom wall of the bleach-fixing chamber is 3 to 200 times of the thickness of the light-sensitive material in a swollen state.

Example 4

Processor 1 was modified so that the circulation amount $V_c$ and the sum of the cross section area of the inlet $S_e$ of the fixing solution were changed as shown in Table 4, and the shape of the lower member 13Y of the processing chamber was changed as shown in FIGS. 5*a* to 5*c*. The experiments were carried out in the manner similar to that in Example 1 except that the above-mentioned.

FIGS. 5*a* to 5*c* are drawings showing the concrete structure of processing chamber 1Y. FIG. 5*a* shows the upper member 12Y defining the shape of the upper wall of the processing chamber and the pairs of conveying roller 16Y, 17Y and 18Y for transporting the light-sensitive material through the processing chamber of the processor used in Example 4. FIG. 5*b* shows an example of the lower member 13Y of the processing chamber which defines the shape of the bottom of the processing chamber and also functions as the transporting guide for the light-sensitive material. The lower member has plural slit-shaped nozzles 27Y which spout the processing solution. The slit-shaped nozzles are provided on the bottom wall of the lower member 13Y in the direction across the conveying direction of the light-sensitive material. The nozzles have a length longer than the width of the light-sensitive material processed in the chamber. FIG. 5*c* shows another example of the lower member 13Y of the processing chamber similar to that shown in FIG. 5*b,* except that many holes for spouting the processing solution are uniformly provided in a area of the bottom wall wider than the width of the light-sensitive material to be processed in the chamber in the direction of conveying the light-sensitive material.

FIGS. 6*a* and 6*b* shows an example of the processing chamber according to the invention. FIG. 6*a* shows a cross section view of the chamber and FIG. 6*b* shows the arrangement of the nozzles 27Y viewed from the side to which the processing solution is spouted from the nozzles. The nozzles 27Y are distributed in a form of plural lines in the direction across the conveying direction of the light-sensitive material and the length of the line is longer than the width of the light-sensitive material to be processed. The nozzles are arranged, as shown in FIG. 6*b,* at an equal interval in the line and the position of the nozzles in the each of the lines are staggered with respect to the adjacent line by a half pitch of the nozzles arranged in the line. Unevenness of the processing is inhibited because the nozzles are arranged in a staggered distribution with respect to the conveying direction of the light-sensitive material. The nozzles each have a diameter of 2.0 mm and spout the processing solution to the surface of the light-sensitive material at an angle of 90°.

Experiment Nos. 4-1 to 4-20 were performed in the same manner as in Experiment No. 3-9 except that two kinds of processor each having processing chambers shown in FIG. 3 and that shown in FIG. 5*b* were used. The processed light-sensitive material was evaluated in the remaining silver amount and the unevenness of fixation. The unevenness of the fixation and the appearance of scratches formed on the processed light-sensitive material were evaluated visually by the following standard.

Appearance of unevenness of fixation

A: Unevenness of fixation is not observed at all.

B: Unevenness of fixation is observed a little near the perforated portion of the light-sensitive material.

C: Unevenness of fixation is observed.

Appearance of scratches

A: No scratch is observed

B: No problem was occurred though slight scratches are observed

C: Scratches are clearly observed

Thus obtained results are listed in Table 4.

TABLE 4

| Experiment No. | Additive | $V_C$ (l/min) | $S_t$ ($cm^2$) | Shape of processing solution inlet | Remained silver (mg/100 $cm^2$) | Appearance in fixing unevenness | Appearance of scratches | Note |
|---|---|---|---|---|---|---|---|---|
| 4-1 | None | 5 | 4.25 | 1 | 4.92 | C | C | Comp. |
| 4-2 | None | 5 | 4.25 | 2 | 4.81 | C | C | Comp. |
| 4-3 | III-10 | 2.25 | 4.25 | 1 | 0.71 | B | A | Inv. |
| 4-4 | III-10 | 2.25 | 4.25 | 2 | 0.63 | B | A | Inv. |
| 4-5 | III-10 | 2.5 | 4.25 | 1 | 0.52 | A | A | Inv. |
| 4-6 | III-10 | 2.5 | 4.25 | 2 | 0.29 | A | A | Inv. |
| 4-7 | III-10 | 5 | 0.25 | 1 | 0.53 | B | A | Inv. |
| 4-8 | III-10 | 5 | 0.25 | 2 | 0.47 | B | A | Inv. |
| 4-9 | III-10 | 5 | 1 | 1 | 0.35 | A | A | Inv. |
| 4-10 | III-10 | 5 | 1 | 2 | 0.28 | A | A | Inv. |
| 4-11 | III-10 | 5 | 4.25 | 1 | 0.13 | A | A | Inv. |
| 4-12 | III-10 | 5 | 4.25 | 2 | 0.11 | A | A | Inv. |
| 4-13 | III-10 | 5 | 10 | 1 | 0.28 | A | A | Inv. |
| 4-14 | III-10 | 5 | 10 | 2 | 0.21 | A | A | Inv. |
| 4-15 | III-10 | 5 | 12.5 | 1 | 0.43 | B | A | Inv. |
| 4-16 | III-10 | 5 | 12.5 | 2 | 0.38 | B | A | Inv. |
| 4-17 | III-10 | 20 | 4.25 | 1 | 0.37 | A | B | Inv. |
| 4-18 | III-10 | 20 | 4.25 | 2 | 0.31 | A | B | Inv. |
| 4-19 | III-10 | 22.5 | 4.25 | 1 | 0.39 | B | B | Inv. |
| 4-20 | III-10 | 22.5 | 4.25 | 2 | 0.32 | B | B | Inv. |

The above results show that the effect of the invention is enhanced when the relation of $5 \times V_w \leqq V_c 40 \times V_w$ is satisfied. The effect of the invention is also enhanced when the relation of $0.5 \times S_e \leqq V_c \leqq 5 \times S_e$ is satisfied. The inlet having a nozzle-shape gives better results.

Example 5

Experiments were carried out in the same manner as in Example 1 except that Compound III-10 was used to all of them and the amount of which is varied as shown in Table 5. In the experiments, Automatic Processor 1 and Fixer Replenisher 2 were used. On the other hand, fixing solution in the first fixing chamber was sampled and stored for 2 weeks at −10° C. in a sealed container. Appearance of the fixing solution after storage was visually evaluated according to the following standard.

A: No precipitate is observed.

B: No problem is caused though precipitates are slightly observed.

C: Precipitates are observed.

TABLE 5

| Experiment No. | A/TS* × 100 (%) | Remained silver (mg/100 cm$^2$) | Appearance in fixing chamber | Appearance of fixer after storage | Note |
|---|---|---|---|---|---|
| 5-1 | 0.03 | 0.51 | B | A | Inv. |
| 5-2 | 0.05 | 0.21 | A | A | Inv. |
| 5-3 | 0.2 | 0.18 | A | A | Inv. |
| 5-4 | 1.0 | 0.13 | A | A | Inv. |
| 5-5 | 2.0 | 0.31 | A | A | Inv. |
| 5-6 | 5.0 | 0.38 | A | A | Inv. |
| 5-7 | 6.0 | 0.53 | B | B | Inv. |

*: Weight ratio of the additive (A) to thiosulfate (TS)

As is shown in Table 5, the fixing ability of the fixing solution can be enhanced and precipitation and adhesion of which on the surface of the light-sensitive material can be prevented by adjusting the weight ratio of the compound of the invention III-10 to that of thiosulfate to 0.05 to 5% by weight.

Example 6

Processor 1 used in Example 1 was modified by attaching a solid processing composition supplying device shown in FIG. 7 so as to supply a solid state fixer composition. A prismatic cartridge containing tablets of processing composition was on each of the solid composition supplying devices. Imagewise exposed Konica Color Super LV100 Film was processed by the above modified processor.

FIG. 7 shows an example the constitution of the solid processing composition supplying device. The solid processing composition supplying device is attached on the auxiliary tanks of the second fixing chamber Fix 2 of Automatic Processor 1 shown in FIG. 1.

In the device shown in FIG. 7, the solid processing composition 111 is contained in a cartridge 101, inside of which is divided to several sections, and sealed by a slidable cap 102. The cap 102 is opened when the cartridge is set up on a cartridge holder 103 of the solid processing composition supplying device attached on the auxiliary tank of the second fixing chamber Fix 2, and a tablet is fallen down into an opening 105 of a rotating cylinder 104 from the cartridge obliquely set on the device. The openings 105 of the rotating cylinder 104 are alternately provided so that the two or more tables contained in the different sections are not fallen down at the same time.

The processing solutions charged in the each processing cambers and channels were each prepared by using the replenishing and starter solutions of Konica Color Negative Film Processing Compositions for Process CNK-4-52, manufactured by Konica Corporation.

On the other hand, the following solid fixing compositions for color negative film were prepared.

Operation 1

In a bantam mill on the market, 175 g of sodium thiosulfate, 1575 g of ammonium thiosulfate, 180 g of sodium sulfite, 20 g of potassium carbonate, 20 g of di-sodium ethylenediaminetetraacetate, 70 g of Pineflow and 1705 g of Compound III-10 were powdered so that the average particle size of the powder is become to 30 μm. The powder was granulated with 50 ml of water by a stirring granulation machine for 10 minutes at room temperature. Thus obtained granules were dried for 120 minutes at 60° C. by a floating layer dryer for almost completely removing moisture contained in the granules. The dried granules were made so that the average size is to be 800 μgm and 50% of the granules were within the deviation range of ±250 μm.

Operation 2

To the granules obtained by Operation 7, 30 g of sodium N-lauroylsarcosine was added and mixed in a mixer for 5 minutes in a room conditioned at 25° C. and a RH of not more than 45%. Then the granules were tableted in an amount of 10 g per tablet by the tableting machine of modified Tough Press Collect 1527HU. Thus fixer replenisher tablets each having a diameter of 30 mm and a thickness of 10 mm were prepared.

The above prepared fixer replenisher tablet was supplied to fixing solution replenished in a ratio of one tables per 2.4 rolls of the color negative film (24 exp.) processed.

Processing using usual liquid replenisher is referred to replenishing form 1 and that using the tablets is referred to replenishing form 2.

Further experiments using the powdered fixing replenisher composition before granulation, and the granulated composition each prepared in the above-mentioned Operation 1 were performed. The powdered or granulated composition were replenished in a rate of 10 g per 2.4 rolls of the 24 ex. color negative film. The replenishing form using powdered and granulated composition are referred to replenishing form 3 and replenishing form 4, respectively.

The powdered and granulated composition were supplied each through a device showing in FIG. 8.

FIG. 8 shows a cross-section of the device for supplying the powdered or granulated composition. The composition is charged in a hopper 71, and a prescribed amount of that is fallen into a measuring hole 72 provided to a slidable piston 75. The piston 75 is moved according to the processed amount of the light-sensitive material to the position 74 drawn by chain line, and the measured composition is discharged from the hole and supplied to the processing solution to be replenished. The piston 75 is back to the starting position after discharging the composition.

Experiments were carried out using the automatic processor of FIG. 1 and the solid processing composition supplying devices shown in FIGS. 7 and 8 in the same manner as in Example 1 except that the replenishing for the processing solutions, other than the fixing solution, were carried out by using the above-mentioned tableted compositions and that compound III-10 was used as the addendum. The replenishing form for the fixing solution was varied as shown in Table 6. In Replenishing Form 1 for the fixing solution, Fixer Replenisher 2 used in Example 1 was used. To the processor used in the experiment. The standard the same as for fixing chamber is applied for evaluation of appearance of the first stabilizing chamber, STB-1. Results of the experiments are listed in Table 6.

TABLE 6

| Experiment No. | Replenishing form of fixer | Additive | Remained silver (mg/100 $cm^2$) | Appearance in fixing chamber | Appearance in 1st stabilizing chamber | Note |
|---|---|---|---|---|---|---|
| 6-1 | 1 | III-10 | 0.13 | A | B | Inventive |
| 6-2 | 2 | III-10 | 0.10 | A | A | Inventive |
| 6-3 | 3 | III-10 | 0.11 | A | A | Inventive |
| 6-4 | 4 | III-10 | 0.11 | A | A | Inventive |

As is shown in Table 6, better results can be obtained when the solid replenishing composition, particularly tableted composition is used for replenishing the fixing solution.

Example 7

Experiments 7-1 to 7-6 were carried out in the same manner as in Experiment 6-2 in Example 6 using Fixer Replenisher 2 except that the time for fixing process was varied as shown in Table 7 by modifying the conveying course of the light-sensitive material in the fixing process, and replenishing composition containing no compound of the invention was used in a part of the experiments. The fixing time given in Table 7 is the total time in the fixing chambers-1 and -2, and the time in each of the chambers was equal.

Results of the experiments are listed in Table 7.

TABLE 7

| Experiment No. | Additive | Processing time | Remained silver (mg/100 $cm^2$) | Appearance in fixing chamber | Note |
|---|---|---|---|---|---|
| 7-1 | None | 90 | 5.21 | B | Comparative |
| 7-2 | III-10 | 90 | 0.10 | A | Inventive |
| 7-3 | None | 80 | 6.62 | A | Inventive |
| 7-4 | III-10 | 80 | 0.15 | A | Inventive |
| 7-5 | None | 60 | 13.10 | A | Inventive |
| 7-6 | III-10 | 60 | 0.28 | A | Inventive |

As is shown in Table 8, the processing time can be considerably reduced by the use of the compound of the invention.

What is claimed is:

1. A method for processing a silver halide photographic light-sensitive material by an automatic processor having a processing chamber comprising conveying a silver halide photographic light-sensitive material, imagewise exposed to light and developed with a developer, through a chamber which is filled with a processing solution having a fixing ability, wherein said processing chamber comprises an upper member constituting an upper wall of said chamber, a lower member constituting a bottom wall of said chamber and a conveyor for said light sensitive material, and said upper wall and said bottom wall forming a small volume, and said solution having a fixing ability contains a thiosulfate in an amount of 0.6 moles to 4 moles per liter and a compound represented by the following Formula I, II, III, IV-1, IV-2, IV-3, IV-4, IV-5, or IV-6 and a ratio of said compound to said thiosulfate is 0.05% to 5% by weight:

Formula I

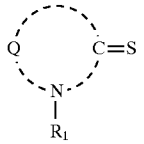

wherein Q is a group of atoms necessary to form a nitrogen-containing heterocyclic ring; and $R_1$ is a hydrogen atom, an alkyl group having 1 to 6 carbon atoms, a cycloalkyl group, an aryl group, a heterocyclic group, Formula II

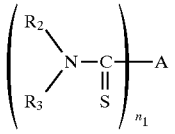

wherein $R_2$ and $R_3$ are each a hydrogen atom, an alkyl group having 1 to 6 carbon atoms, a hydroxyl group, a carboxyl group, an amino group, an acyl group having 1 to 3 carbon atoms, an aryl group or an alkenyl group; A is —(C=X)—N(R)(R'), —$(CH_2)n_2$—(C=X)—N(R)(R'), —$(S)m_1$—(C=X)—N(R)(R'), —$(S)m_2$—$(CH_2)n_3$—(C=X)—N(R)(R'), —$(S)m_3$—$(CH_2)n_4$—N(R)(R'), —$(S)m_4$—N(R)(R'), —$(NH)n_5$—$(CH_2)m_5$—$(NH)n_6$—(C=X)—N(R)(R'), —S—S—(C=X)—(R)(R'), —SZ or an $n_1$-valent heterocyclic group; in which R and R' are each synonymous with $R_2$ and $R_3$; X is =S, =O or =NR"; Z is a hydrogen atom, an alkali metal atom, an ammonium group, an amino group, a nitrogen-containing heterocyclic residue, an alkyl group such as a methyl group or an ethyl group or —S—B—Y$(R_4)(R_5)$; R" is a hydrogen atom, an alkyl group having 1 to 6 carbon atoms, a cycloalkyl group, an aryl group, a heterocyclic residue or an amino group; and $n_1$ to $n_6$ and $m_1$ to $m_5$ are each an integer of 1 to 6; B is an alkylene group having 1 to 6 carbon atoms, Y is —N<, =C< or —CH<; $R_4$ and $R_5$ are each synonymous with $R_2$ and $R_3$. $R_4$ and $R_5$ each may be —B—SZ; and $R_2$ and $R_3$, and $R_4$ and $R_5$ each may be bonded together to form a ring;

Formula III

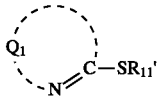

wherein $Q_1$ is a group of atoms necessary for forming a nitrogen-containing heterocyclic ring; $R_{11}$ is a hydrogen atom, an alkali metal atom,

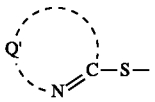

or an alkyl group; Q' is synonymous with $Q_1$;

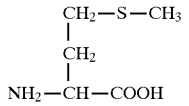

IV-1

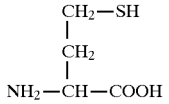

IV-2

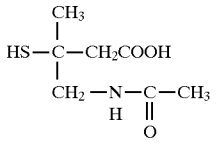

IV-3

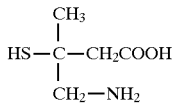

IV-4

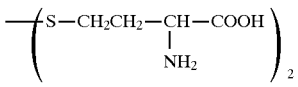

IV-5

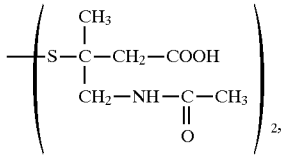

IV-6 thereby improving fixation.

2. The method of claim 1, wherein said compound is one represented by Formula III.

3. The method of claim 1, wherein said processing solution having a fixing ability is a fixing solution.

4. The method of claim 1, wherein said processing solution having a fixing ability is replenished during the course of the processing by a replenishing composition in a form of a solid.

5. The method of claim 1, wherein the distance between said upper wall and said bottom wall of said processing chamber in the direction perpendicular to the surface of said light-sensitive material conveyed in said processing chamber is 3 to 200 times of the thickness of the light-sensitive material in a swollen state.

6. The method of claim 1, wherein said automatic processor has a circulation means for circulating the processing solution having a fixing ability through the processing chamber and a circulation channel connected with said processing chamber and said circulation means.

7. The method of claim 6, wherein the volume of said processing solution contained in said processing chamber $V_w$ and the volume of said processing solution contained in said circulating channel $V_f$ satisfy the relation of $V_w \leqq V_f$.

8. The method of claim 6, wherein the circulating rate of the processing solution in said circulation channel $V_c$ in l/min. and the volume of the processing solution contained in said processing chamber $V_w$ in l satisfy the relation of $5 \times V_w \leqq V_c \leqq 40 \times V_w$.

9. The method of claim 6, wherein the inlet of the processing solution to said processing chamber from said circulation channel has a form of a nozzle through which the processing solution is spouted to the surface of the light-sensitive material conveyed in the processing chamber.

10. The method of claim 6, wherein the circulating rate of the processing solution in said circulation channel $V_c$ in l/min. and the total of sectional area of the inlet of the processing solution to said processing chamber from said circulation channel $S_e$ in $cm^2$ satisfy the relation of $0.5 \times S_e \leqq V_c \leqq 5 \times S_e$.

* * * * *